US012781450B2

(12) United States Patent
Dameron et al.

(10) Patent No.: US 12,781,450 B2
(45) Date of Patent: Nov. 3, 2026

(54) CRASH ATTENUATOR ASSEMBLIES FOR DECELERATING VEHICLES

(71) Applicant: Hill & Smith Inc., Columbus, OH (US)

(72) Inventors: Andrew J. Dameron, Hilliard, OH (US); Gerrit A. Dyke, Stockton, CA (US)

(73) Assignee: Hill & Smith Inc., Columbus, OH (US)

( * ) Notice: Subject to any disclaimer, the term of this patent is extended or adjusted under 35 U.S.C. 154(b) by 155 days.

(21) Appl. No.: 18/846,251

(22) PCT Filed: Mar. 18, 2023

(86) PCT No.: PCT/US2023/064676
§ 371 (c)(1),
(2) Date: Sep. 11, 2024

(87) PCT Pub. No.: WO2023/178342
PCT Pub. Date: Sep. 21, 2023

(65) Prior Publication Data

US 2025/0146239 A1 May 8, 2025

Related U.S. Application Data

(60) Provisional application No. 63/321,512, filed on Mar. 18, 2022.

(51) Int. Cl.
*E01F 15/14* (2006.01)

(52) U.S. Cl.
CPC ..... *E01F 15/146* (2013.01)

(58) Field of Classification Search
CPC ..... E01F 15/145
See application file for complete search history.

(56) References Cited

FOREIGN PATENT DOCUMENTS

| | | | | |
|---|---|---|---|---|
| BR | 102023014764 A2 * | 1/2024 | ..... | E01F 15/143 |
| CN | 114059478 A | 2/2022 | | |
| EP | 0773326 A1 | 5/1997 | | |
| GB | 2637526 A * | 7/2025 | ..... | E01F 15/143 |
| KR | 101041234 B1 | 6/2011 | | |
| WO | WO-2020173612 A1 | 9/2020 | | |

OTHER PUBLICATIONS

International Search Report and Written Opinion dated Jun. 29, 2023 for corresponding International Application No. PCT/US2023/064676.

* cited by examiner

*Primary Examiner* — Sarah B McPartlin
(74) *Attorney, Agent, or Firm* — Dugan Law Office, LLC

(57) ABSTRACT

Crash attenuator assemblies are operable to decelerate errant vehicles traveling along roadways. The crash attenuator assemblies include guide rails anchorable to a ground surface adjacent a roadway. Frame assemblies are supported on the guide rails and are displaced upon impact by errant vehicles. The frame assemblies are spaced longitudinally along the guide rail such that a bay is defined between adjacent ones of the frame assemblies. A compressible energy absorber is disposed within one of the bays. A piercing device is operative to penetrate into said compressible energy absorber upon compression of the compressible energy absorber during an impact event to create an aperture that is a visually observable identifier of compression of the compressible energy absorber beyond a predetermined compression threshold.

20 Claims, 19 Drawing Sheets

CRASH ATTENUATOR ASSEMBLIES FOR DECELERATING VEHICLES

This application is the National Stage of International Application No. PCT/US2023/064676, filed on Mar. 18, 2023, which claims the benefit of priority from U.S. Provisional Patent Application No. 63/321,512, filed on Mar. 18, 2022, the entire contents of which is hereby incorporated herein by reference.

BACKGROUND

The subject matter of the present disclosure broadly relates to the art of roadway safety devices and, more particularly, to crash attenuation assemblies for decelerating vehicles during errant travel along roadways.

Vehicle roadways are arranged as a network of thoroughfares. In many cases, the roads are interconnected with one another at intersections and/or interchanges by which vehicles travel from one road to another. When traveling on high-speed roadways (e.g., highways, motorways), vehicles may utilize dedicated entry and/or exit ramps that permit the vehicle to safely transfer onto, off of or otherwise between high-speed roadways and other thoroughfares. In other cases, one roadway may cross over or under other roadways as well as other geographic and/or human-made features by way of bridges, tunnels, underpasses and/or overpasses.

The foregoing and/or other roadway structures are built or otherwise installed adjacent the roadways in close proximity to vehicles traveling therealong. As discussed above, in many cases, the vehicles utilizing the roadway may be traveling at high rates of speed. As such, vehicle crash attenuators of a variety of types, kinds and constructions have been developed that decelerate errant vehicles to mitigate injury of vehicle occupants and prevent damage to the roadway structures. Such vehicle crash attenuators are installed in front of (relative to the normal direction of vehicle travel) roadway structures and other immovable objects located adjacent the roadway such that errant vehicles impact the crash attenuator instead of making contact with the corresponding roadway structure or other immovable object.

Known vehicle crash attenuators can include one or more guide rails that are secured to the ground surface in front of the roadway structure or other immovable object. Numerous frame assemblies are spaced apart on the one or more guide rails and interconnected with one or more energy dissipation devices. Upon impact from an errant vehicle, the frame assemblies are displaced along the one or more guide rails toward the roadway structure or other immovable object. The one or more energy dissipation devices act to decelerate the vehicle as the different frame assemblies are forced by the moving vehicle toward the roadway structure or other immovable object. Movement of the errant vehicle is stopped once the energy of the vehicle has been fully dissipated by the vehicle crash attenuator.

In some cases, the impact of an errant vehicle will displace each of the frame assemblies the full length (or at least nearly the full length) of the one or more guide rails. In other cases, the frame assemblies may be partially advanced along the one or more guide rails. In either case, known vehicle crash attenuators are constructed to be reset in preparation for reuse during future impact events. In some cases, known vehicle crash attenuators can include one or more reusable energy dissipation devices that provide a braking force to decelerate the errant vehicle during an impact event. Such fully-resettable crash attenuators typically require few, if any, parts or components to be replaced to return the vehicle crash attenuators to service. As such, known fully-resettable crash attenuators can be reset quickly and at minimal cost.

Fully-resettable crash attenuators are particularly useful certain situations, such as high-traffic areas, but require substantial initial investment on the part of the municipality or territorial government purchasing, installing and maintaining the vehicle crash attenuator. In some cases, such fully-resettable crash attenuators may exceed budget limitations of certain municipalities, which can be a barrier to installation. In other cases, a municipality or territorial government may identify locations of roadway structures and/or other immovable objects adjacent roadways for which vehicle crash attenuators may be desired but for which the cost of known fully-resettable crash attenuators is unjustifiable or outside budget constraints. Such locations may be along low-traffic and/or lower-speed roadways as well as locations at which less-frequent impact events are likely to occur.

To address the foregoing, vehicle crash attenuators that utilize sacrificial energy dissipation devices have been developed and can be installed at a lower cost than fully-resettable crash attenuators. Such vehicle crash attenuators provide comparable impact dissipation to fully-resettable crash attenuators, but may require additional time and/or replacement components to return the vehicle crash attenuators to service after an impact event. In particular, known vehicle crash attenuators utilize compressible cartridges between adjacent ones of the displaceable frame assemblies. As an errant vehicle forces the displaceable frame assemblies along the length of the one or more guide rails, one or more of the cartridges disposed therebetween are permanently compressed to dissipate the energy of the vehicle. After such impact events, such one or more of the cartridges may be in condition for replacement.

Notwithstanding the common usage and overall success of known types and kinds of vehicle crash attenuators, it is believed desirable to develop vehicle crash attenuator assemblies that may provide comparable or improved performance, reduced cost of manufacture, installation and/or repair, otherwise address problems and/or disadvantages of known constructions, and/or otherwise advance the art of roadway safety and mitigation of vehicle impacts with roadway structure or other immovable objects adjacent roadways.

BRIEF DESCRIPTION

One example of a crash attenuator assembly in accordance with the subject matter of the present disclosure can be operable to decelerate an associated errant vehicle during an associated impact event. The crash attenuator assembly can include a guide rail anchorable to an associated ground surface adjacent an associated roadway. The guide rail can extend in a longitudinal direction from a first rail end to a second rail end opposite the first rail end. A plurality of frame assemblies can be supported on the guide rail for longitudinal displacement therealong, such as may be due to impact of the associated errant vehicle. The plurality of frame assemblies can be oriented transverse to the guide rail and can extend therefrom in a vertical direction away from the associated ground surface. The plurality of frame assemblies can be disposed in longitudinally-spaced relation to one another along the guide rail such that a plurality of bays are defined longitudinally along the guide rail with each of the plurality of bays disposed between adjacent ones of the plurality of frame assemblies. At least one of the plurality of frame assemblies can include a piercing device disposed in facing relation to a corresponding one of the plurality of bays. A compressible energy absorber can be disposed within the one of the plurality of bays. The piercing device is operative to penetrate into the compressible energy absorber thereby creating an aperture operable as a visually observable identifier of compression of the compressible energy absorber during the associated impact event to an amount exceeding a predetermined compression threshold.

Another example of a crash attenuator assembly in accordance with the subject matter of the present disclosure can be operable to decelerate an associated errant vehicle during an associated impact event. The crash attenuator assembly can include a guide rail anchorable to an associated ground surface adjacent an associated roadway. The guide rail can extend in a longitudinal direction from a first rail end to a second rail end opposite the first rail end. A plurality of frame assemblies can be supported on the guide rail for longitudinal displacement therealong, such as may be due to impact of the associated errant vehicle. The plurality of frame assemblies can be oriented transverse to the guide rail and can extend therefrom in a vertical direction away from the associated ground surface. The plurality of frame assemblies can be disposed in longitudinally-spaced relation to one another along the guide rail such that a plurality of bays are defined longitudinally along the guide rail with each of the plurality of bays disposed between adjacent ones of the plurality of frame assemblies. At least one of the plurality of frame assemblies can include a piercing device disposed in facing relation to a corresponding one of the plurality of bays. An energy absorption cartridge can be disposed within the one of the plurality of bays. The energy absorption cartridge can include a cartridge shell and an energy absorption body. The cartridge shell can include a shell wall at least partially defining a shell chamber. The energy absorption body can be at least partially formed from a polymeric foam material and can be encased within the shell chamber by the cartridge shell. The shell wall can include a wall portion disposed in facing relation to the piercing device of the one of the plurality of frame assemblies. The piercing device is operative to penetrate through the wall portion of shell wall and into communication with the shell chamber upon compression of the energy absorption cartridge against the one of the plurality of frame assemblies and thereby create an aperture within the end wall portion. The aperture is operable as a visually observable identifier of compression of the energy absorption cartridge during the associated impact event to an amount exceeding a predetermined compression threshold.

A further example of a crash attenuator assembly in accordance with the subject matter of the present disclosure can be operable to decelerate errant vehicles. The crash attenuator assembly can include a guide rail anchorable to an associated ground surface adjacent an associated roadway. The guide rail can extend in a longitudinal direction from a first rail end to a second rail end opposite the first rail end. A first frame assembly can be disposed along the first end of the guide rail and supported for sliding displacement longitudinally therealong. A second frame assembly can be disposed along the second end of the guide rail and anchorable in stationary relation thereto. A plurality of intermediate frame assemblies can be supported on the guide rail for sliding displacement longitudinally therealong. The plurality of intermediate frame assemblies can be disposed in spaced relation to one another between the first and second frame assemblies such that a plurality of bays are defined longitudinally along the crash attenuator assembly with one of the plurality of bays between adjacent ones of the first frame assembly, the second frame assembly and the plurality of intermediate frame assemblies. A piercing device is supported on the first frame assembly, the second frame assembly or one of the plurality of intermediate frame assemblies. The piercing device can be oriented in facing relation to an adjacent one of the plurality of bays. A plurality of compressible energy absorbers with each disposed within a different one of the plurality of bays. One of the plurality of compressible energy absorbers including a surface portion disposed in facing relation to the piercing device such that the piercing device is operative to penetrate into the compressible energy absorber along the surface thereof upon compression of the compressible energy absorber in an amount exceeding a predetermined compression threshold thereby creating an aperture along the surface of the compressible energy absorber. The aperture is operable as a visually observable identifier of compression of the compressible energy absorber to an amount exceeding the predetermined compression threshold.

Yet another example of a crash attenuator assembly in accordance with the subject matter of the present disclosure can be operable to decelerate errant vehicles. The crash attenuator assembly can include a guide rail anchorable to an associated ground surface adjacent an associated roadway. The guide rail can extend in a longitudinal direction from a first rail end to a second rail end opposite the first rail end. A first frame assembly can be disposed along the first end of the guide rail and supported for sliding displacement longitudinally therealong. A second frame assembly can be disposed along the second end of the guide rail and anchorable in stationary relation thereto. A plurality of intermediate frame assemblies can be supported on the guide rail for sliding displacement longitudinally therealong. The plurality of intermediate frame assemblies can be disposed in spaced relation to one another between the first and second frame assemblies such that a plurality of bays are defined longitudinally along the crash attenuator assembly with one of the plurality of bays between adjacent ones of the first frame assembly, the second frame assembly and the plurality of intermediate frame assemblies. A piercing device is supported on the first frame assembly, the second frame assembly or one of the plurality of intermediate frame assemblies. The piercing device can be oriented in facing relation to an adjacent one of the plurality of bays. A plurality of energy absorption cartridges with each disposed within a different one of the plurality of bays. The plurality of energy absorption cartridges can include a cartridge shell and an energy absorption body. The cartridge shell can include a shell wall at least partially defining a shell chamber. The energy absorption body can be at least partially formed from a polymeric foam material and encased within the shell chamber by the cartridge shell. The shell wall of one of the plurality of energy absorption cartridges can include a wall portion disposed in facing relation to the piercing device such that the piercing device is operative to penetrate through the wall portion of shell wall and into communication with the shell chamber upon compression of the energy absorption cartridge in an amount exceeding a predetermined compression threshold thereby creating an aperture within the wall portion. The aperture is operable as a visually observable identifier of compression of the energy absorption cartridge to an amount exceeding the predetermined compression threshold.

DETAILED DESCRIPTION

Turning now to the drawings, it is to be understood that the showings are for purposes of illustrating examples of the subject matter of the present disclosure and that the same are not intended to be limiting. Additionally, it will be appreciated that the drawings are not to scale and that portions of certain features and/or elements may be exaggerated for purposes of clarity and/or ease of understanding.

Figure 1:
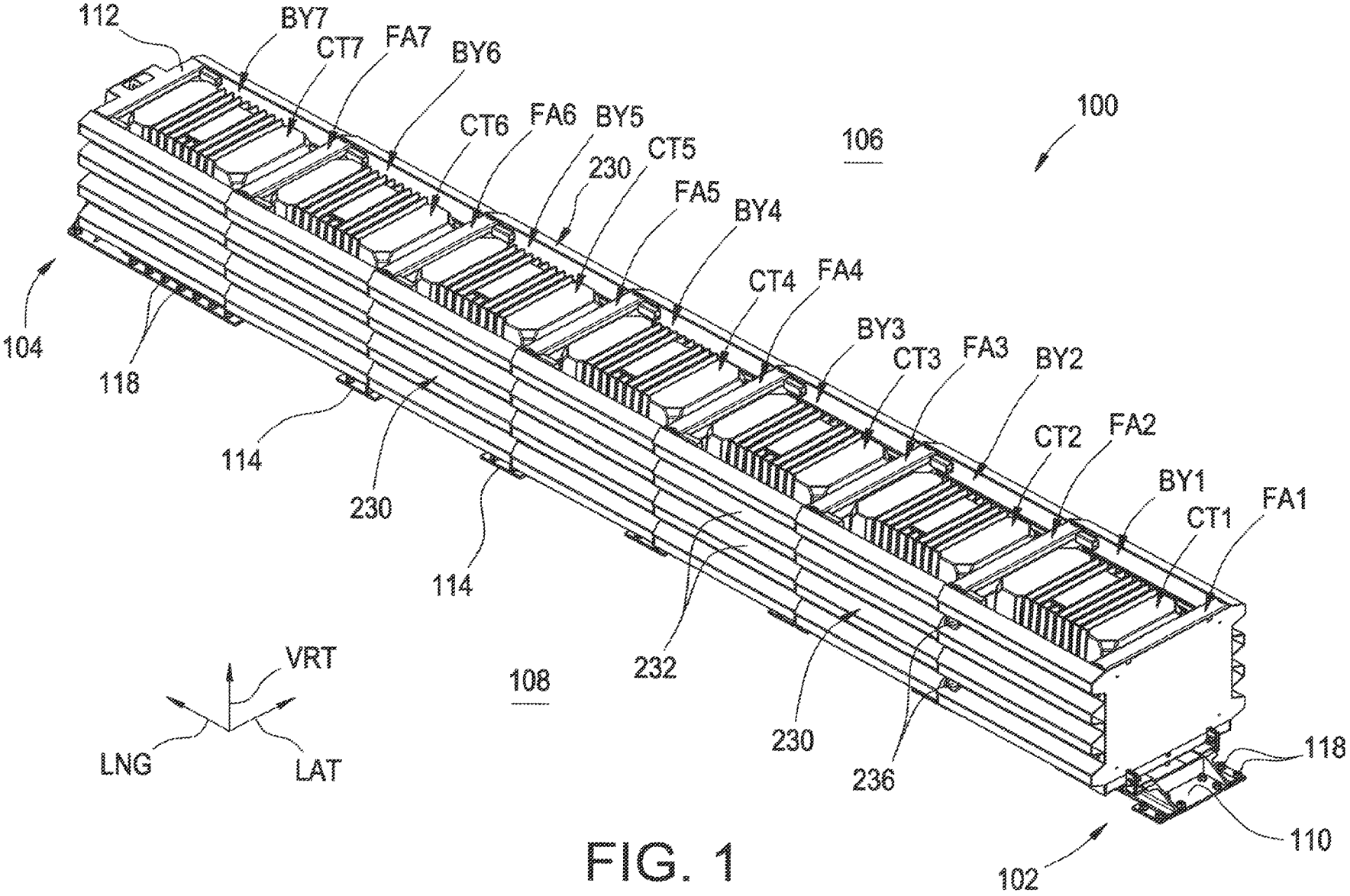
FIG. 1 is a top perspective view of one example of a crash attenuation assembly in accordance with the subject matter of the present disclosure.
Figure 2:
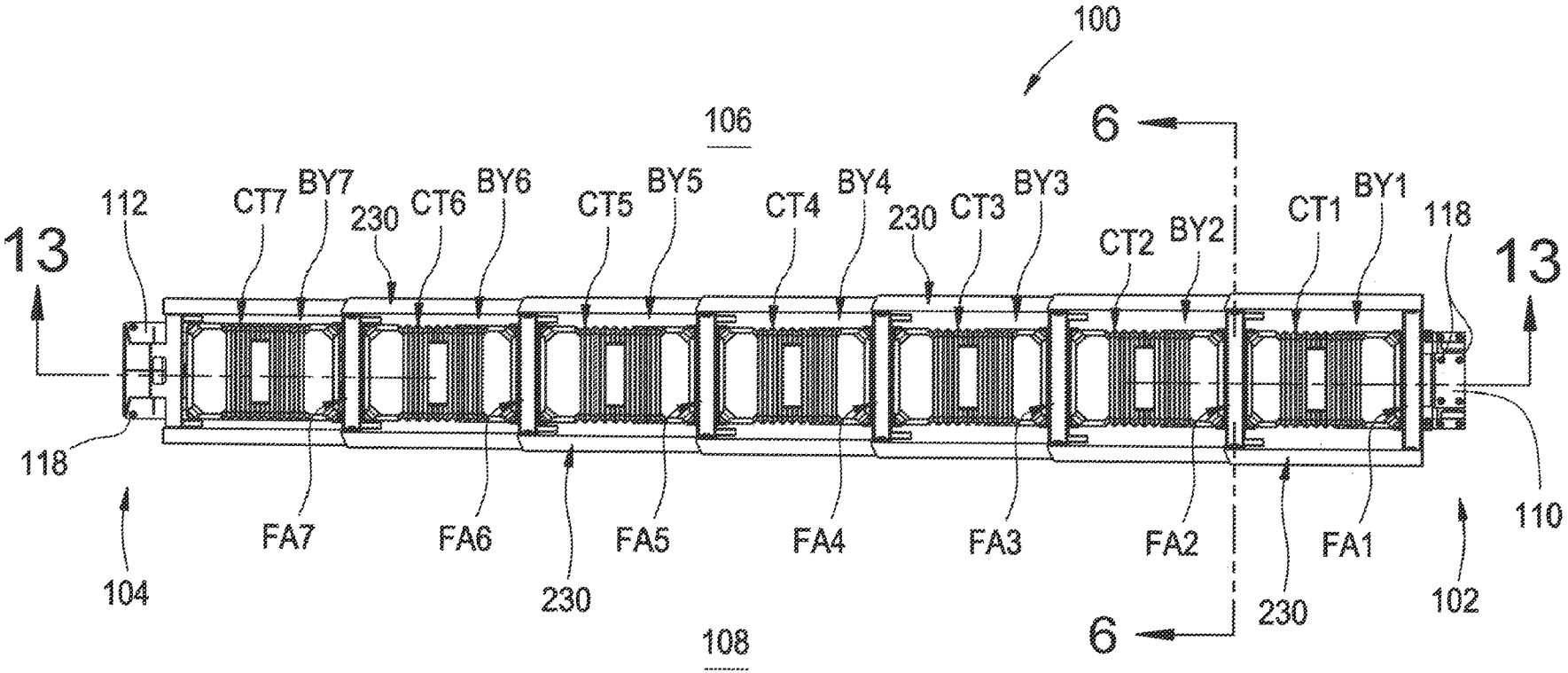
FIG. 2 is a top plan view of the exemplary crash attenuation assembly in FIG. 1.
Figure 3:
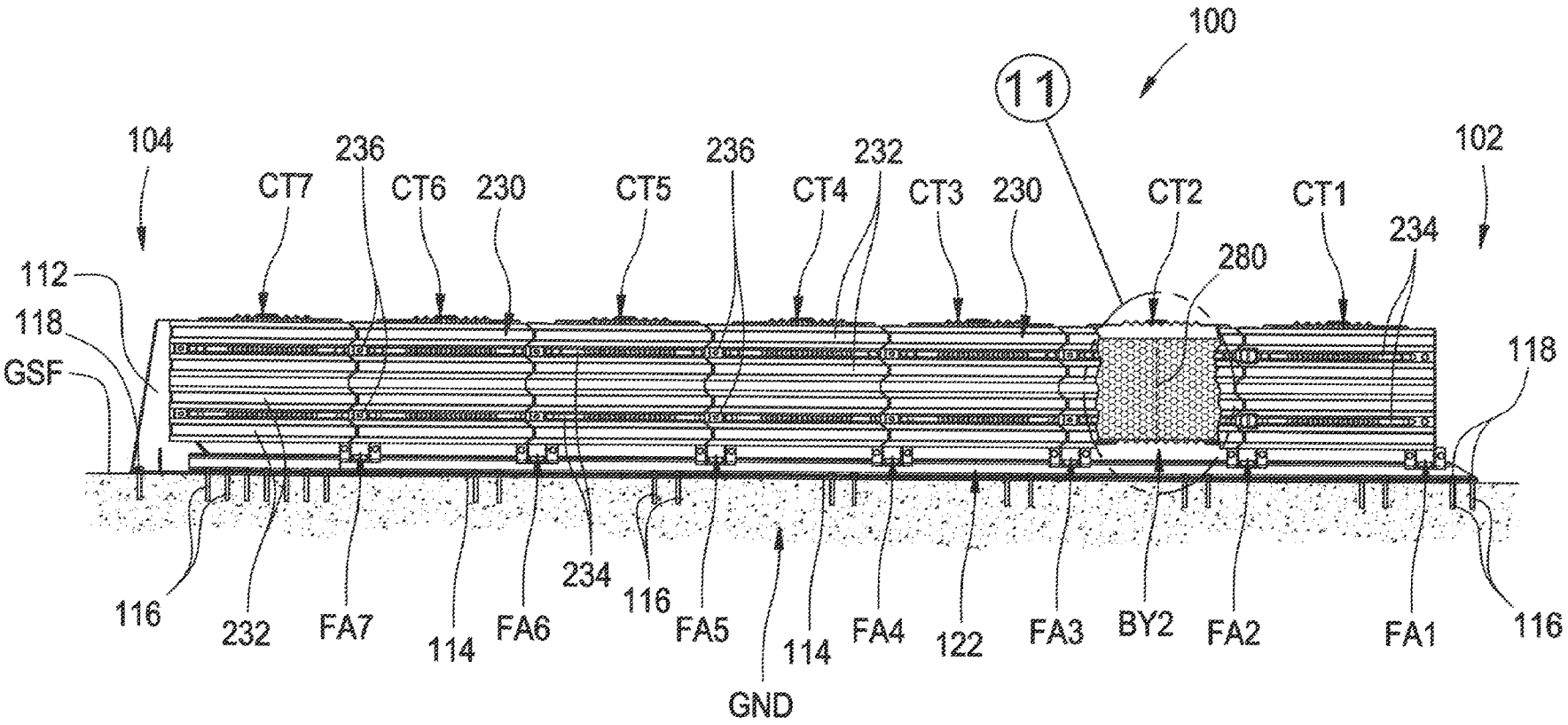
FIG. 3 is a side elevation view, in partial cross section, of the exemplary crash attenuation assembly in FIGS. 1 and 2.
Figure 4:
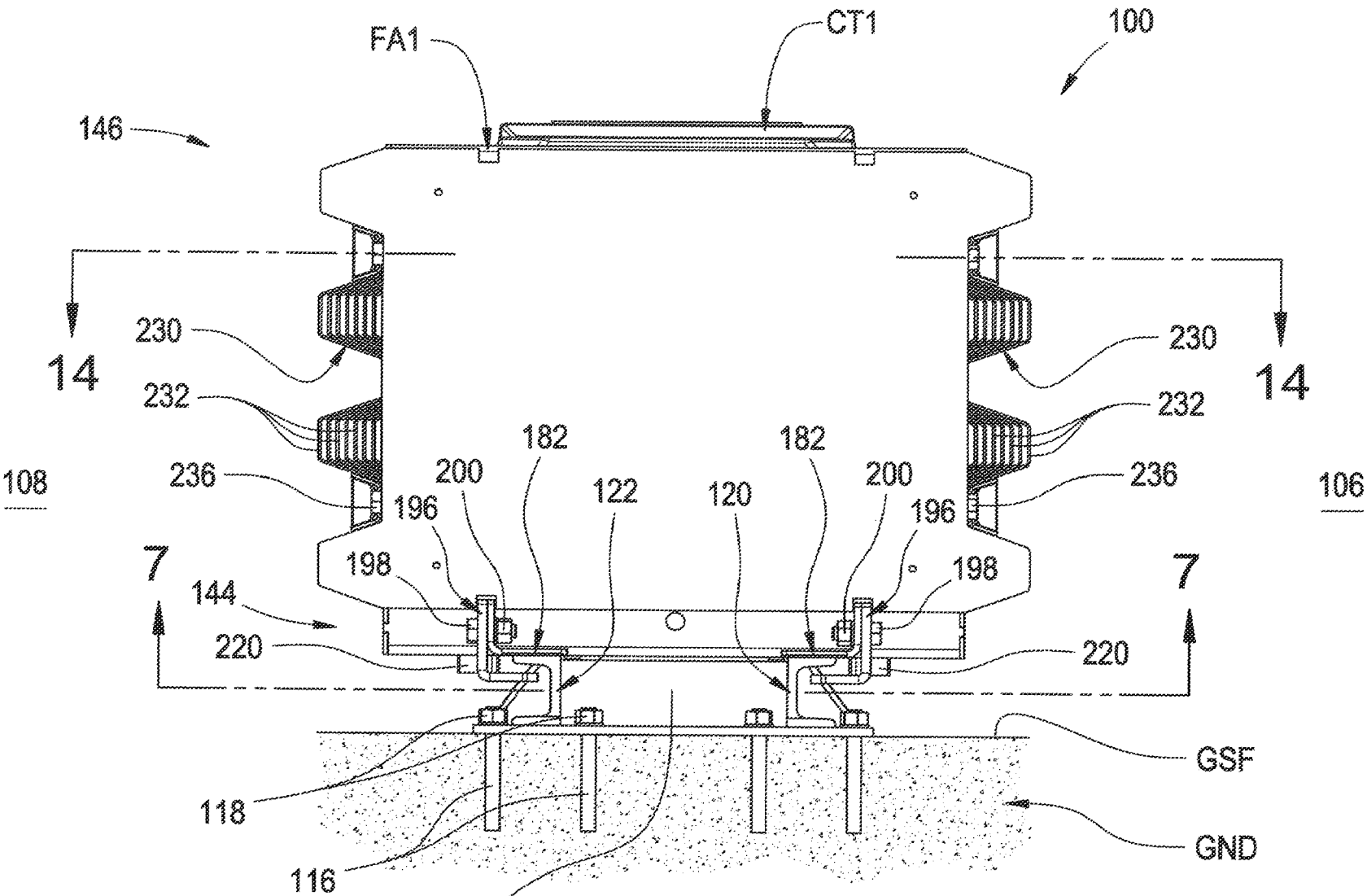
FIG. 4 is a front elevation view of the exemplary crash attenuation assembly in FIGS. 1-3.
Figure 5:
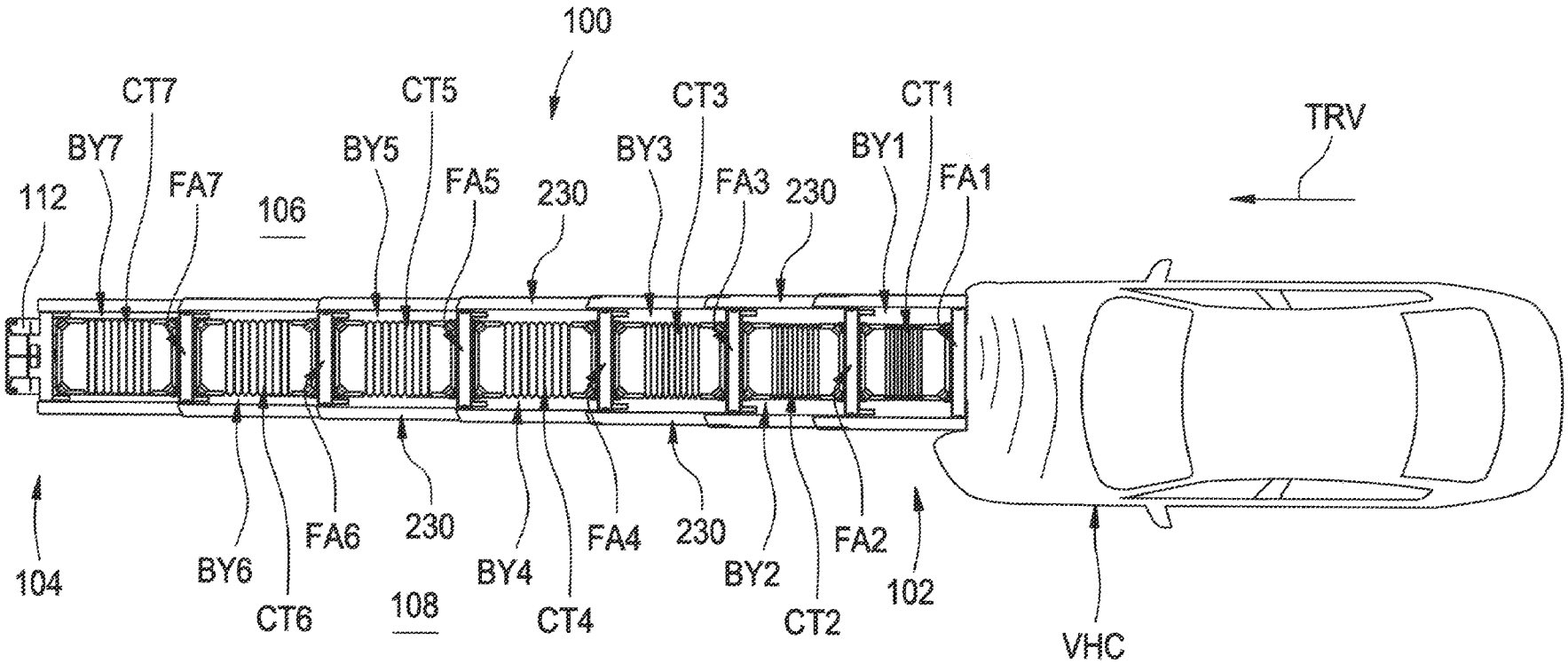
FIG. 5 is a top plan view of the exemplary crash attenuation assembly in FIGS. 1-4 in use decelerating an associated errant vehicle.

One example of a crash attenuation assembly 100 in accordance with the subject matter of the present disclosure is shown in FIGS. 1-7, 13 and 14 and is operable to decelerate an errant vehicle traveling along a roadway, such as is illustrated in FIG. 5, for example. As shown therein an errant vehicle VHC is traveling in a direction indicated by arrow TRV and, upon impact, compresses portions of crash attenuation assembly 100 in the direction of travel. Crash attenuation assembly 100 is shown in FIGS. 1-4, 6, 7, 13 and 14 in an extended position in which the crash attenuation assembly is in condition to be impacted by and decelerate an errant vehicle. In FIG. 5, components of crash attenuation assembly 100 are partly compressed or otherwise displaced due to the impact of errant vehicle VHC. It will be appreciated that to function as intended, some components and/or assemblies of crash attenuation assembly 100 is/are anchored and maintained in a fixed or stationary position relative to the ground surface during an impact event.

Crash attenuation assembly 100 extends in a longitudinal or lengthwise direction, represented by arrow LNG, from an end 102 toward an end 104. For discussion purposes, end 102 of assembly 100 may be referred to herein by terms such as "front", "forward", "forward end" and the like. Again, for discussion purposes, end 104 of assembly 100 may be referred to herein by terms such as "back", "rear", "rearward end" and the like. Crash attenuation assembly 100 has a side 106 and a side 108 opposite side 106 in a lateral or widthwise direction, such as is represented by arrow LAT. Assembly 100 extends in a vertical or heightwise direction, as is represented by arrow VRT, from along a ground surface GSF of ground GND, and for discussion purposes may be referred to herein by the orientations "bottom" or "lower" for features toward or along ground surface GSF and by the orientations "top" or "upper" for features above or space away from ground surface GSF. It will be appreciated that ground GND is representative any substantially stationary mass, such as may be at least partially formed of earthen (e.g., soil, rock), concrete and/or asphalt materials, for example. As non-limiting examples, ground GND can include roadways, medians, berms, bridge decks and/or other such structures on or along which crash attenuation assembly 100 may be installed.

Crash attenuation assembly 100 includes an anchor frame 110 disposed along end 102 and an anchor base (or stationary frame assembly) 112 disposed along end 104 in longitudinally-spaced relation to anchor frame 110. In some cases, a plurality of (intermediate) anchor plates 114 can, optionally, be positioned in longitudinally-spaced relation to one another between anchor frame 110 and anchor base 112. Anchor frame 110, anchor base 112 and anchor plates 114, if included, can be anchored to or otherwise secured on or along ground surface GSF in any suitable manner. As one non-limiting example, a plurality of securement devices 116 (e.g., anchor bolts, L-bolts, J-bolts) could be embedded within ground GND and project outwardly beyond ground surface GSF to which the anchor frame, the anchor base and any intermediate anchor plates could be secured, such as by way of securement devices 118 (e.g., threaded nuts), for example.

Crash attenuation assembly 100 also includes one or more guide rails that extend longitudinally between ends 102 and 104. In the exemplary arrangement shown herein, assembly 100 includes a guide rail 120 disposed toward side 106 and a guide rail 122 disposed toward side 108. Guide rails 120 and 122 are spaced apart from one another in lateral or widthwise direction LAT, and can be anchored to or otherwise secured on or along ground surface GND in any suitable manner. As one example, guide rails 120 and 122 can be attached to anchor frame 110 along end 102 of assembly 100 and attached to anchor base 112 along end 104 of assembly 100. Guide rails 120 and 122 can also be attached to anchor plates 114, if included. As discussed above, it will be appreciated that anchor frame 110, anchor base 112 and anchor plates 114, if included, are securable to ground GND along ground surface GSF thereof. Guide rails 120 and 122 are attached to anchor frame 110, anchor base 112 and anchor plates 114, if included, and are thereby securable along ground surface GSF of ground GND. It will be appreciated that guide rails 120 and 122 can be secured on or along anchor frame 110, anchor base 112 and/or anchor plates 114, if included, in any suitable manner, such as by way of permanent and/or removable fasteners and/or by way of flowed-material joints, for example.

Figure 6:
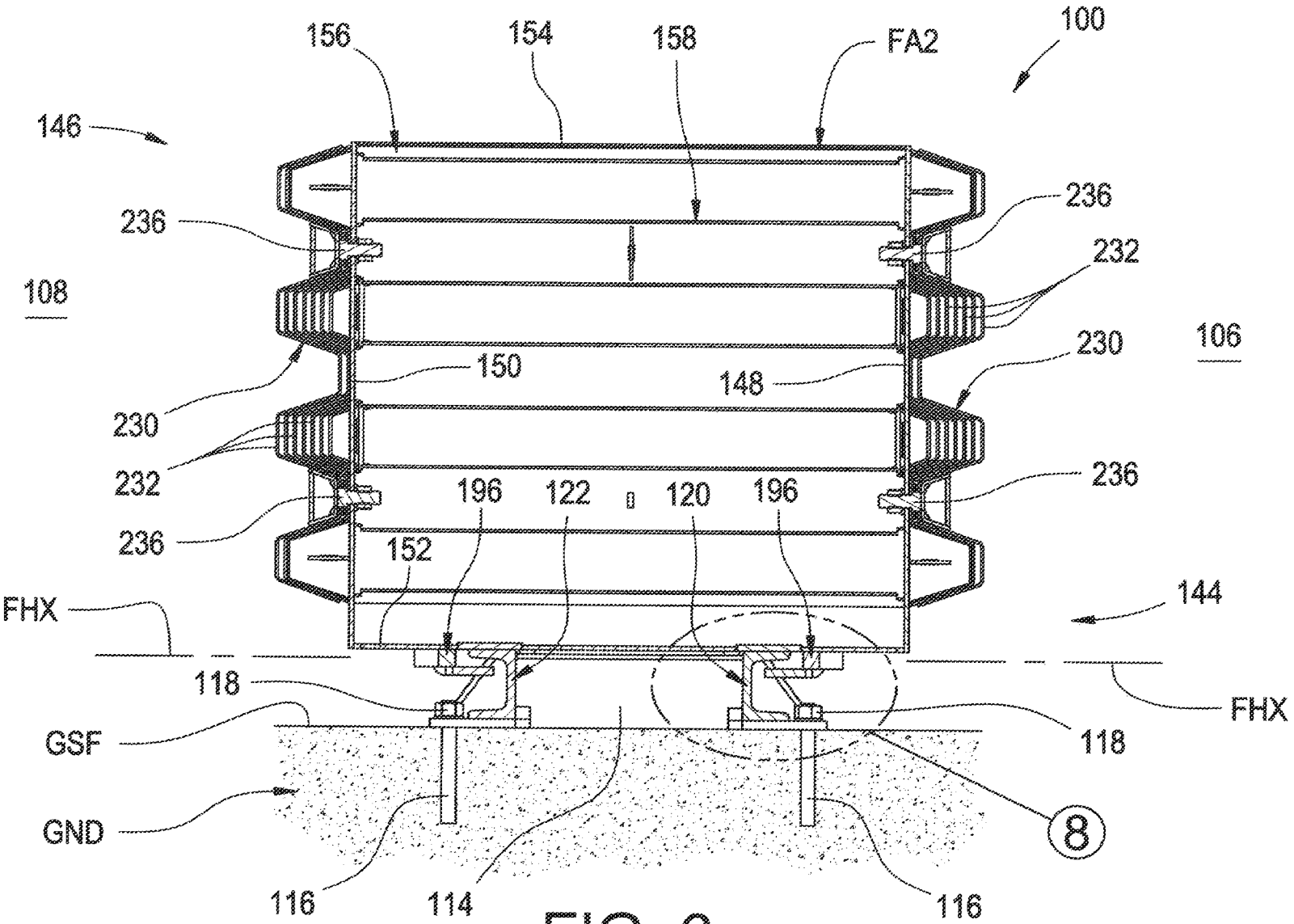
FIG. 6 is a cross-sectional view of the exemplary crash attenuation assembly in FIGS. 1-5 taken from along line 6-6 in FIG. 2.
Figure 7:
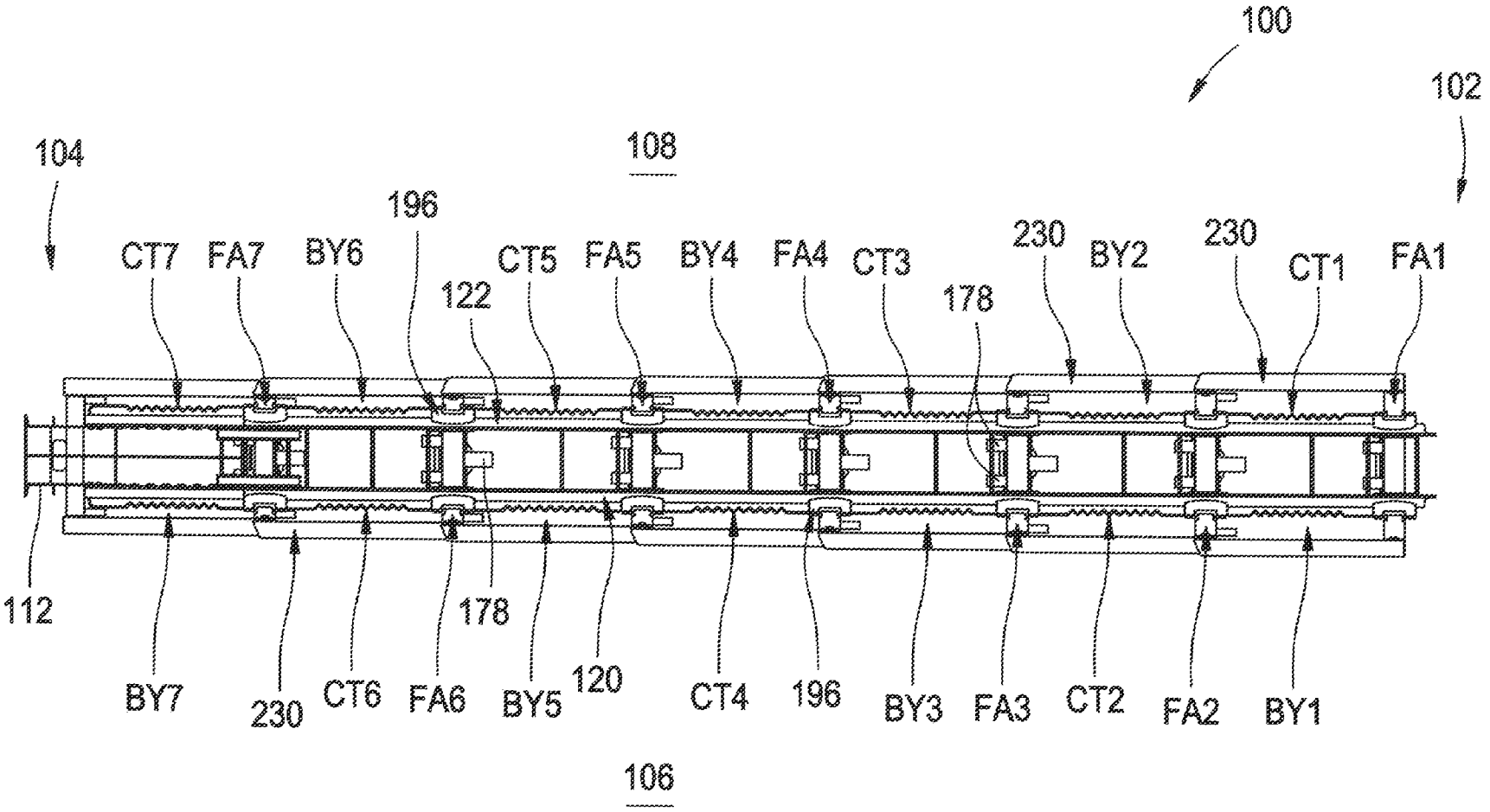
FIG. 7 is a cross-sectional view of the exemplary crash attenuation assembly in FIGS. 1-6 taken from along line 7-7 in FIG. 4.
Figure 8:
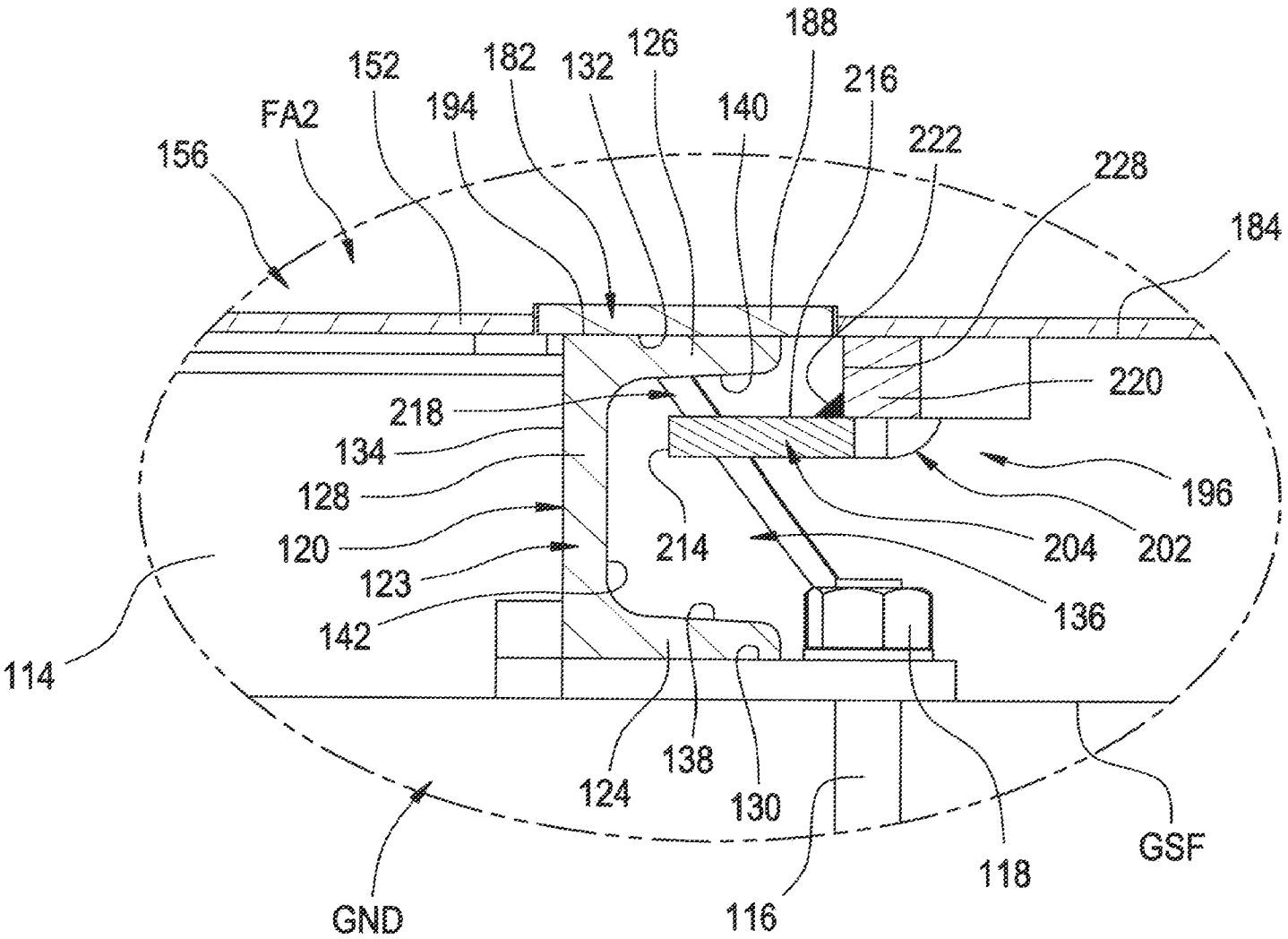
FIG. 8 is an enlarged view of the portion of the exemplary crash attenuation assembly in FIGS. 1-7 identified as Detail 8 in FIG. 6.
Figure 9:
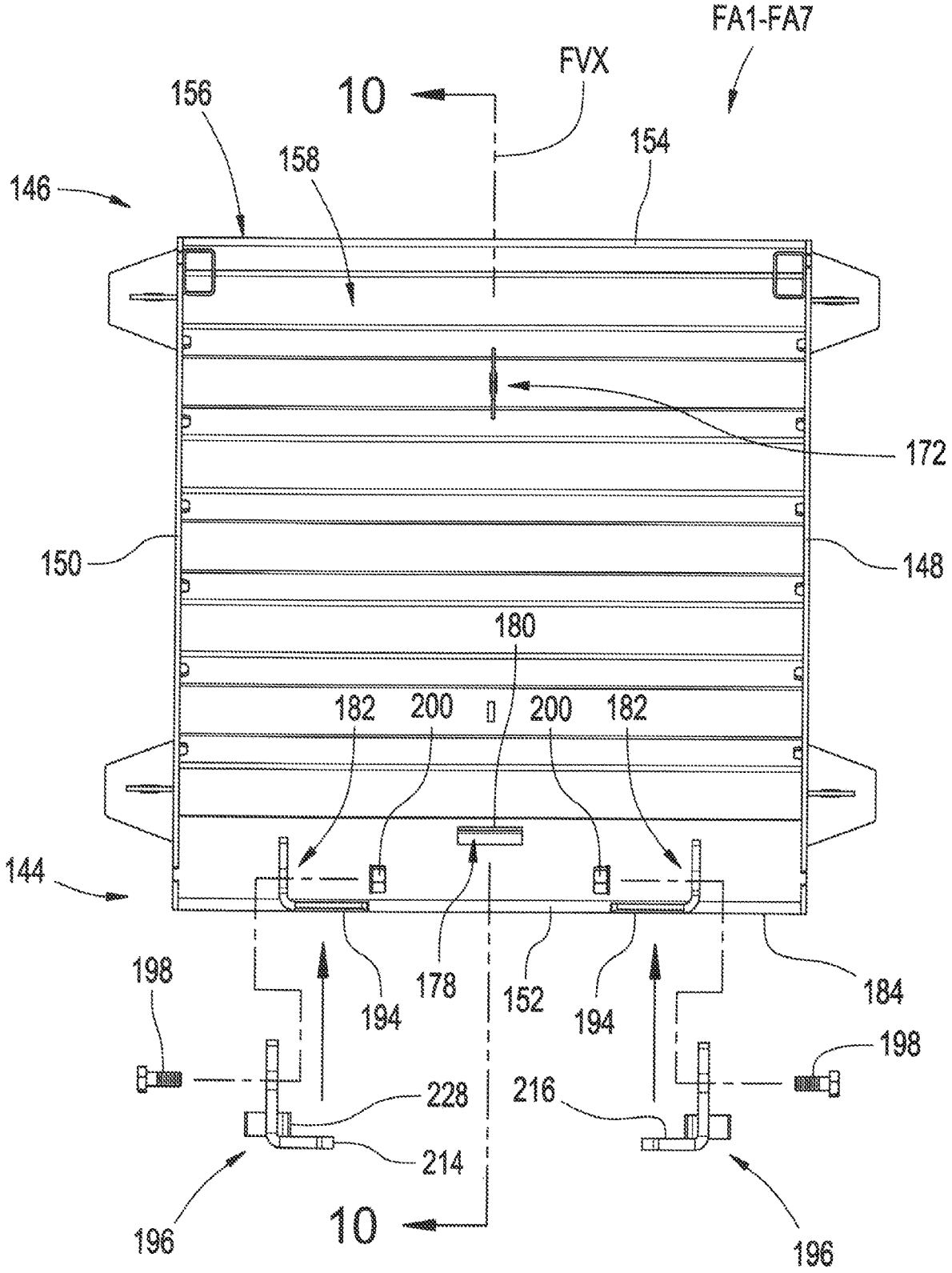
FIG. 9 is an exploded front elevation view of an exemplary frame assembly of the exemplary crash attenuation assembly in FIGS. 1-8.

Guide rails 120 and 122 can include any suitable number and/or configuration of walls and/or wall portions. In some cases, the guide rails can have different cross-sectional shapes or configurations relative to one another. In a preferred arrangement, however, guide rails 120 and 122 will have the same cross-sectional shape and configuration of walls and/or wall portions. Guide rails 120 and/or 122 will have a cross-sectional profile taken from along a vertical plane oriented transverse to the elongated length of the guide rails, such as is shown in FIGS. 4, 6 and 8, for example. It will be appreciated that, in some cases, the cross-sectional shape can be symmetrical across a vertical centerline (e.g., a W-beam profile, train rail profile). In other cases, the cross-sectional shape of the guide rails can be asymmetrical about a vertical centerline (e.g., a C-channel profile). Guide rails 120 and 122 are spaced apart from one another in the lateral direction. In cases in which guide rails having an asymmetric cross-sectional shape are included, the guide rails are preferably arranged in opposing orientations relative to one another (e.g., both C-channel profiles facing inward or both C-channel profiles facing outward).

As a non-limiting example of one suitable cross-sectional profile, guide rails 120 and 122 can include a rail wall 123 formed from a metal material (e.g., steel) with a base wall portion 124 and a flange wall portion 126 that is offset from the base wall portion in a vertical or heightwise direction. A web wall portion 128 extends between and interconnects base wall portion 124 and flange wall portion 126. Base wall portion 124 includes a base surface portion 130 facing toward ground surface GSF. In a preferred arrangement, base surface portion 130 can be disposed on or along anchor frame 110, anchor base 112 and any intermediate anchor plates 114, if included. Flange wall portion 126 includes a support surface portion 132 facing opposite base surface portion 130. Web wall portion 128 includes a side surface portion 134 that extends between base wall portion 124 and flange wall portion 126. Guide rails 120 and 122 also include an elongated channel 136 at least partially defined by web wall portion 128 between base wall portion 124 and flange wall portion 126. In such case, base wall portion 124 can include a channel surface portion 138 facing opposite base surface portion 130, flange wall portion 126 can include a channel surface portion 140 facing opposite support surface portion 132, and web wall portion 128 can include a channel surface portion 142 facing opposite side surface portion 134. Together, channel surface portions 138, 140 and 142 can at least partially define elongated channel 136 as extending lengthwise or longitudinally along guide rails 120 and 122.

A crash attenuation assembly in accordance with the subject matter of the present disclosure also includes a plurality of frame assemblies (or bulkheads) moveably supported on the at least one guide rail. In the arrangement shown herein, crash attenuation assembly 100 includes a plurality of frame assemblies FA1-FA7 that are disposed in longitudinally-spaced relation to one another from end 102 toward end 104. Frame assemblies FA1-FA7 are moveably supported on guide rails 120 and 122 such that the frame assemblies are displaceable longitudinally from end 102 toward end 104, such as may occur during an impact event from errant vehicle VHC as shown in FIG. 5, for example. Additionally, or in the alternative, frame assemblies FA1-FA7 are supported for longitudinal movement along the guide rails from along end 104 toward end 102, such as may occur during resetting actions or activities that would occur after an impact event. Frame assemblies FA1-FA7 extend in vertical or heightwise direction VRT from along guide rails 120 and 122 in a direction away from ground surface GSF. As such, frame assemblies FA1-FA7 are operatively connected to guide rails 120 and 122 along a bottom or lower end 144 of the frame assemblies and extend away from the guide rails toward a top or upper end 146. In a preferred arrangement, frame assemblies FA1-FA7 can have decreasing lateral dimensions in the lateral or widthwise direction with frame assembly FA1 having the greatest width and frame assembly FA7 having the narrowest width with at least a portion of anchor base 112 having a width approximately equal to or less than frame FA7.

Frame assemblies FA1-FA7 can be constructed in any suitably manner and can include any suitable combination of walls and/or wall portions. As one non-limiting example, frame assemblies FA1-FA7 are shown as having a generally common construction, such as is shown in greater detail in FIGS. 6, 9, 10 and 15-19, for example, that includes a side wall 148 disposed toward side 106 and a side wall 150 spaced laterally from side wall 148 toward side 108. Frame assemblies FA1-FA7 also include a bottom or end wall 152 disposed toward end 144 of the frame assemblies as well as a top or end wall 154 disposed in spaced relation to end wall 152 along end 146. Side walls 148 and 150 are rigidly interconnected with end walls 152 and 154 to form a frame structure 156.

A frame panel 158 is disposed within the frame structure and rigidly interconnected with the side walls and end walls thereof, such as by way of flowed material joints, for example. Frame panel 158 can be of any construction and/or configuration suitable for providing rigidity and strength to the frame assemblies. As a non-limiting example, frame panel 158 can include a panel wall 160 with a plurality of corrugations 162, such as may extend horizontally and/or vertically across frame structure 156. As identified in FIG. 10, panel wall 160 can include a plurality of first wall portions 164 and a plurality of second wall portions 166 that are offset longitudinally from first wall portions 164. First wall portions 164 are spaced apart from one another in a direction transverse to the longitudinal direction (e.g., vertically or side-to-side) and second wall portions 166 are spaced apart from one another in the same transverse direction. The first and second wall portions are shown interleaved with one another in the transverse direction. Second wall portions 166 are interconnected with one or more of first wall portions 164 by one or more of a plurality of third wall portions 168. The first, second and third wall portions form a plurality of corrugation grooves 170 arranged such that adjacent grooves (e.g., grooves sharing a common one of third wall portions 168) face in opposite longitudinal directions. It will be appreciated, however, that other configurations and/or arrangements could alternately be used.

Frame assemblies FA1-FA7 also include one or more piercing devices 172 supported on frame panel 158. Piercing devices 172 include a base portion 174 and a tip wall portion 176 that extends from along base portion 174. Piercing devices 172 are positioned along one of first and second wall portions 164 and 166, and are operatively secured on or along panel wall 160 in a suitable manner. For example, at least base portion 174 of the piercing devices can be secured on or along one or more of the first, second and/or third wall portions of the panel wall by way of flowed-material joints, for example. In a preferred arrangement, piercing devices 172 are positioned within one of corrugation grooves 170 with pointed tip 176 recessed within the corrugation groove without projecting longitudinally beyond the other of first and second wall portions 164 and 166 such that substantially all of piercing devices 172 are recessed within the corresponding corrugation groove.

Frame assemblies FA1-FA7 further include one or more cartridge support brackets 178 secured along frame structures 156. For example, cartridge support brackets 178 can extend longitudinally from along panel wall 160 and/or end wall 152, and include a surface portion 180 facing upward toward upper end 146 of the frame assemblies. In the arrangement shown and described herein, each frame assembly includes a plurality of cartridge support brackets 178 with one or more support brackets extending from frame structure 156 in one longitudinal direction and one or more support brackets extending from the frame structure in the other longitudinal direction.

Frame assemblies FA1-FA7 also include one or more frame support brackets attached to frame structure 156 along lower end 144. As a non-limiting example, the frame assemblies can include frame support brackets 182 attached to end wall 152 of the frame structure. End wall 152 includes a surface portion 184 facing toward guide rails 120 and 122. Frame support brackets 182 include a frame bracket wall 186 with a support wall portion 188 and mounting wall portions 190 extending from and oriented transverse to the support wall portion. Mounting wall portions 190 are spaced apart from one another such that a gap 192 is formed therebetween with gap 192 dimensioned to at least partially receive frame structure 156. In a preferred arrangement, frame support brackets 182 are positioned along frame structure 156 with one of mounting wall portions 190 disposed along each longitudinal side of the frame structure and fixedly attached thereto, such as by way of flowed-material joints, for example. Support wall portion 188 includes a sliding surface portion 194 facing toward guide rails 120 and 122. In a preferred arrangement, sliding surface portion 194 is positioned approximately coplanar with surface portion 184 of end wall 152 such that surface portion 184 and/or sliding surface portions 194 slidingly engage support surface portion 132 of guide rails 120 and 122.

Frame assemblies FA1-FA7 also includes guide bracket assemblies 196 that are secured to frame structure 156 and are operative to retain the frame assemblies on or along guide rails 120 and 122 as well as guide the frame assemblies during longitudinal displacement along the guide rails, such as occurs during impact events and/or reset actions, for example. In a preferred arrangement, guide bracket assemblies 196 can be secured to frame structures 156 in any suitable manner. As one non-limiting example, guide bracket assemblies 196 could be attached to frame brackets 182 by way of securement devices 198 threadably engaging securement devices 200. Guide bracket assemblies 196 include a bracket wall 202 that includes a retaining wall portion 204 and mounting wall portions 206 extending from and oriented transverse to retaining wall portion 204. Mounting wall portions 206 are space apart from one another such that a gap 208 is formed therebetween with gap 208 dimensioned to at least partially receive frame structure 156 between the mounting wall portions. Bracket wall 202 extends between side surface portions 210 and 212. Retaining wall portion 204 extends from along mounting wall portions 206 toward a guide surface portion 214 disposed along the distal edge of the retaining wall portion. Bracket wall 202 also includes a contact or retaining surface portion 216 disposed along retaining wall portion 204 that faces toward sliding surface portion 194 of frame bracket 182 in an assembled condition of the frame assemblies. Contact surface portion 216 is disposed in spaced relation to sliding surface portion 194 such that a slot 218 is formed between contact surface portion 216 and sliding surface portion 194 of frame bracket 182 and/or surface portion 184 of end wall 152.

Guide bracket assemblies 196 can also, optionally, include a bracket wall 220 that can be attached to bracket wall 202, such as by way of flowed-material joints 222, for example. Bracket wall 220 can include side surface portions 224 and 226 that face generally opposite one another. Bracket wall 220 can be positioned on or along bracket wall 202 such that side surface portions 224 and 226 extend through gap 208 with each of side surface portions 224 and 226 disposed adjacent a corresponding one of mounting wall portions 206. As such, bracket wall 220 can extend at least partly along contact surface portion 216 of retaining wall portion 204 in a direction toward guide surface portion 214. Bracket wall 220 can include a guide surface portion 228 that is disposed or otherwise extends between side surface portions 224 and 226. In a preferred arrangement, guide surface portion 228 is offset from guide surface portion 214.

Figure 10:
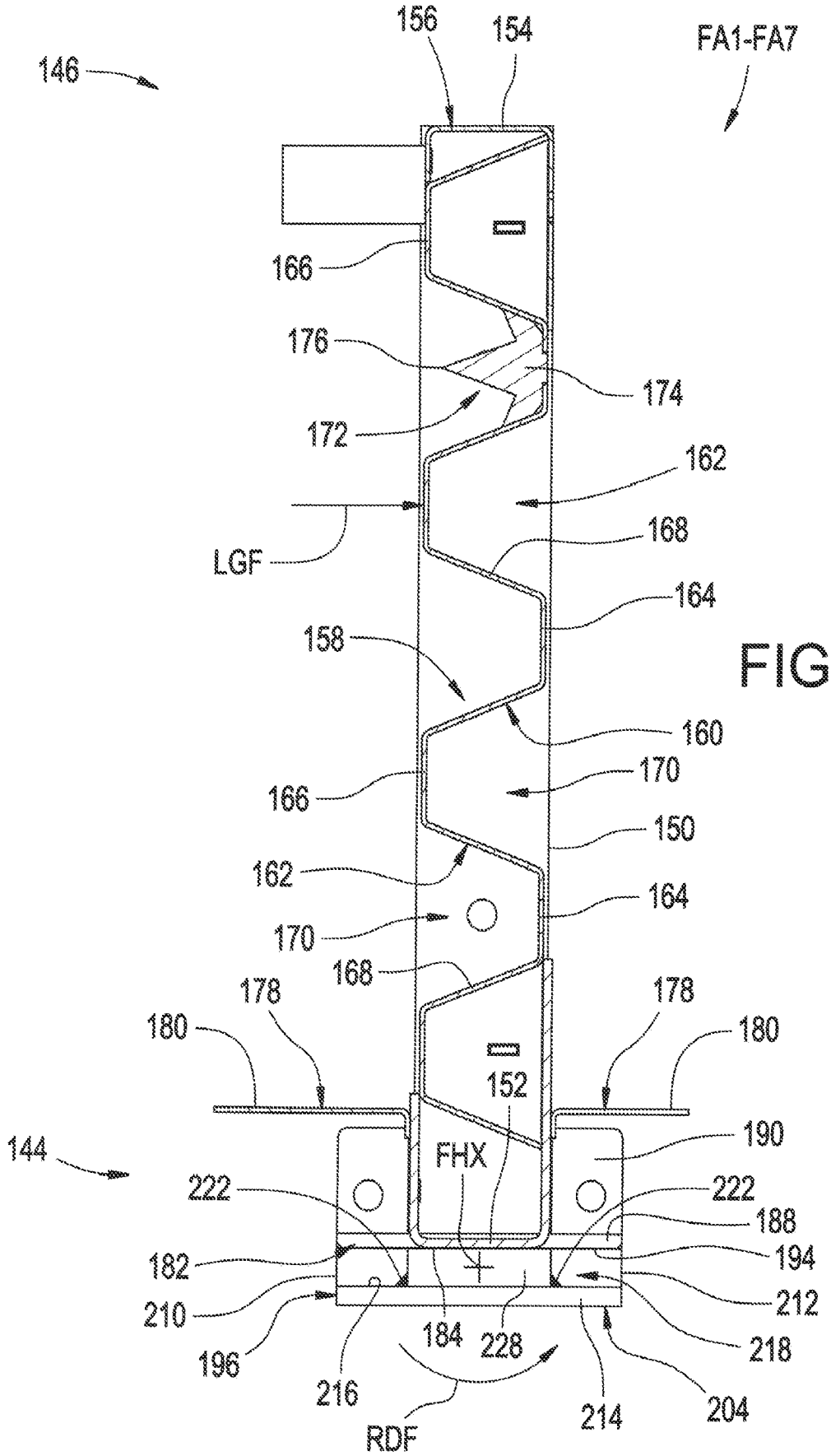
FIG. 10 is a cross-sectional view of the exemplary frame assembly in FIG. 9 taken from along line 10-10 therein.
Figure 11:
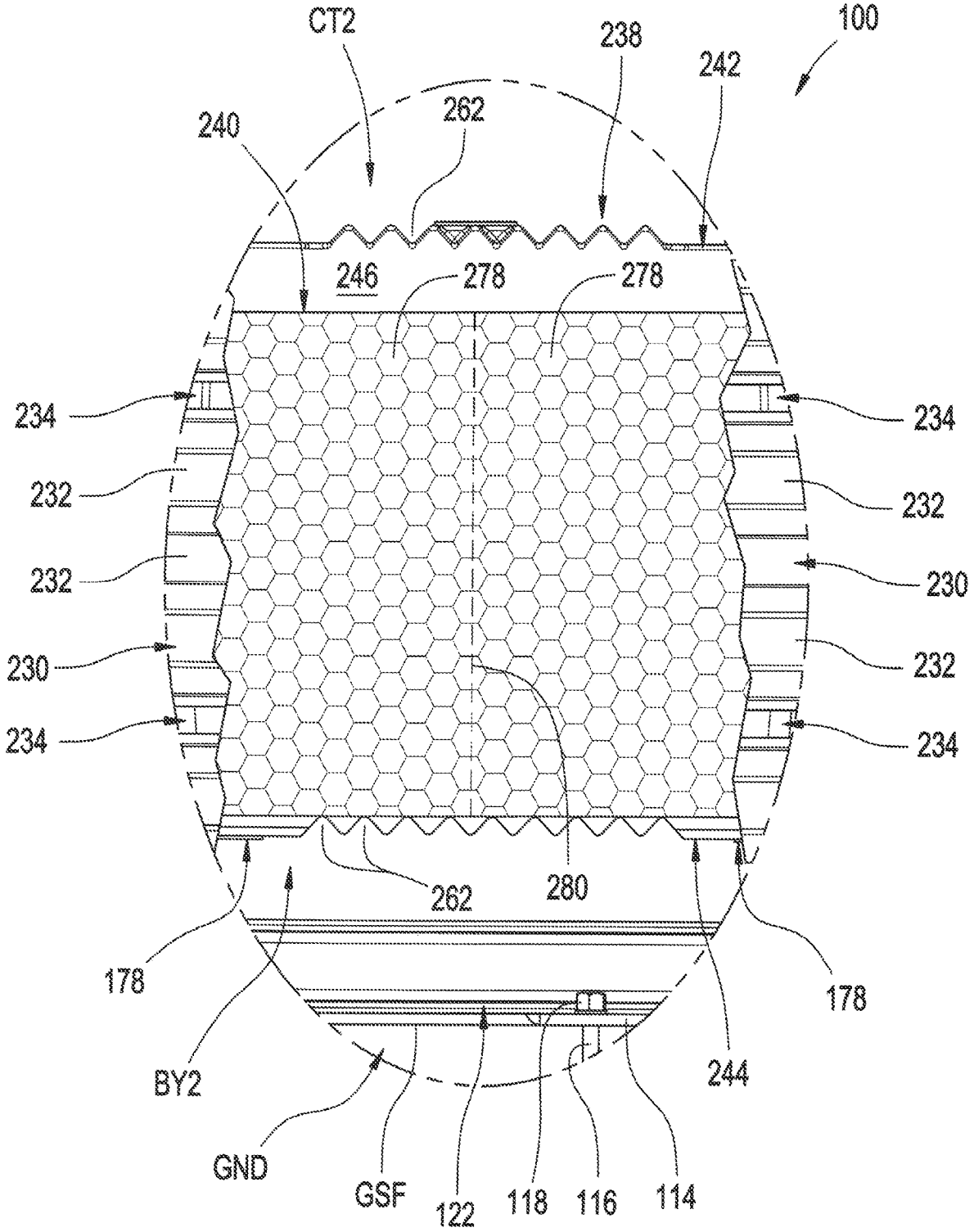
FIG. 11 is an enlarged view of the portion of the exemplary crash attenuation assembly in FIGS. 1-10 identified as Detail 11 in FIG. 3.

Slot 218 between guide bracket assembly 196 and frame bracket 182 and/or frame structure 156 is dimensioned to receive at least some of flange wall portion 126 of guide rails 120 and 122. In such an arrangement, guide surface portion 214 faces channel surface portion 142 and guide surface portion 228 faces a distal edge (not numbered) of flange wall portion 126. As such, frame assemblies FA1-FA7 are retained on or along guide rails 120 and 122 through operative engagement of surface portion 184 and/or sliding surface portion 194 with support surface portion 132 and through engagement of contact surface portion 216 with channel surface portion 140. Frame assemblies FA1-FA7 remain longitudinally displaceable along guide rails 120 and 122 by surface portion 184 and/or sliding surface portion 194 slidingly engaging support surface portion 132 and/or by contact surface portion 216 slidingly engaging channel surface portion 140. In such an arrangement, retaining wall portion 204 of bracket wall 202 inhibits any substantial displacement of frame assemblies FA1-FA7 in a vertical direction away from guide rails 120 and 122. Additionally, in such an arrangement, guide bracket assemblies 196 substantially inhibit rotational deflection of frame assemblies FA1-FA7 about respective frame assembly horizontal axes FHX (FIG. 6) that are oriented lateral to guide rails 120 and 122. As discussed in greater detail hereinafter, frame assemblies FA1-FA7 experience forces acting in the longitudinal direction during impacts from errant vehicles, such as is represented by arrow LGF in FIG. 10, for example. It will be appreciated that longitudinal force LGF generates a moment load on the frame assemblies urging rotational deflection of the frame assemblies around frame assembly axes FHX, such as is represented in FIG. 10 by arrow RDF. However, guide bracket assemblies 196 substantially inhibit rotational deflection RDF of the frame assemblies about axes FHX. As such, guide bracket assemblies 196 retain frame assemblies FA1-FA7 in a substantially vertical orientation such that the frame assemblies slide longitudinally along guide rails 120 and 122 as a result of longitudinal forces LGF. Additionally, or in the alternative, guide bracket assemblies 196 aid in maintaining frame assemblies FA1-FA7 in a lateral orientation transverse to guide rails 120 and 122 as the frame assemblies slide longitudinally along the guide rails and, thus, aid in preventing twisting or racking of the frame assemblies relative to the guide rails.

Frame assemblies FA1-FA7 are positioned along guide rails 120 and 122 in longitudinally-spaced relation to one another between ends 102 and 104. In such an arrangement, frame assemblies FA1 and FA2 are longitudinally-spaced from one another to at least partially define a bay BY1 longitudinally therebetween. Similarly, frame assemblies FA2 and FA3 at least partially define a bay BY2 longitudinally therebetween, frame assemblies FA3 and FA4 at least partially define a bay BY3 longitudinally therebetween, frame assemblies FA4 and FA5 at least partially define a bay BY4 longitudinally therebetween, frame assemblies FA5 and FA6 at least partially define a bay BY5 longitudinally therebetween, frame assemblies FA6 and FA7 at least partially define a bay BY6 longitudinally therebetween, and frame assembly FA7 together with anchor base (or stationary frame assembly) 112 at least partially defines a bay BY7 longitudinally therebetween. It will be appreciated, however, that any suitable quantity of frame assemblies and corresponding bays can be used and that the arrangement shown and described herein is merely exemplary.

Crash attenuation assembly 100 also includes a plurality of side panels 230 disposed along sides 106 and 108. Side panels 230 are operatively connected to frame assemblies FA1-FA7 as well as anchor base (or stationary frame assembly) 112 and act as deflection panels for redirecting errant vehicles impacting the crash attenuation assembly from a lateral or otherwise non-frontal direction. As shown in FIGS. 1-7, 11 and 14, one of side panels 230 is operatively connected between two adjacent frame assemblies along each of sides 106 and 108 of the crash attenuation assembly and enclose the sides of bays BY1-BY7. As discussed above, frame assemblies FA1-FA7 are constructed with laterally-extending widths (i.e., in a side-to-side direction) that decrease from end 102 to end 104. In a preferred arrangement, side panels 230 at least partially overlap one another from end 104 toward end 102 with the side panels secured between anchor base (or stationary frame assembly) 112 and frame assembly FA7 having the narrowest lateral spacing (i.e., closest together) and the side panels secured between frame assemblies FA2 and FA1 having the greatest lateral spacing (i.e., farthest apart).

Side panels 230 can be of any suitable shape, configuration and/or construction. In some case, side panels 230 can include a plurality of longitudinally-extending corrugations 232, such as have been described above in connection with frame panel 158, for example.

Side panels 230 also include a plurality of slots 234 extending longitudinally therealong between adjacent ones of corrugations 232. Side panels 230 can be secured on or along the corresponding frame assemblies in any suitable manner, such as by way of securement devices 236 (e.g., threaded fasteners) extending through slots 234 in side panels 230 for securement on or along side walls 148 and 150 of frame structures 156, for example. It will be appreciated, however, that other configurations and/or arrangements could alternately be used without departing from the subject matter of the present disclosure.

Crash attenuation assembly 100 is longitudinally displaceable between a fully extended condition (FIGS. 1-3, 7, 13 and 14) and a partially or fully collapsed condition (FIG. 5). In the fully extended condition, frame assemblies FA1-FA7 are spaced apart from one another in the longitudinal direction such that frame assembly FA1 is disposed in a substantially-entirely forward position along guide rails 120 and 122 (e.g., adjacent anchor frame 110 at end 102) with frame assemblies FA2-FA7 spaced apart from one another between frame assembly FA1 and anchor base (or stationary frame assembly) 112. That is, in the fully extended condition, frame assembly FA1 is disposed along end 102 with frame assemblies FA2-FA7 successively spaced from frame assembly FA1 and one another in the longitudinal direction toward end 104, such as is shown in FIGS. 1-3, 7, 13 and 14, for example. In such a fully extended condition, crash attenuation assembly is operable to dissipate kinetic energy of an errant vehicle and decelerate the errant vehicle upon impact with frame assembly FA1 along end 102, such as is shown in FIG. 5, for example. In the collapsed condition, which refers to full collapse as well as partial collapse, frame assemblies FA1-FA7 are spaced apart from one another along less than the full longitudinal length of guide rails 120 and 122. As such, upon impact, frame assemblies FA1-FA7 are displaced longitudinally toward end 104 with each of bays BY1-BY7 collapsing or otherwise decreasing in size as the frame assemblies move along guide rails 120 and 122 toward anchor base (or stationary frame assembly) 112. During such longitudinal displacement, side panels 230 are telescopically received with one another in a coextensive or other overlapping arrangement along sides 106 and 108. It will be appreciated that such telescopic displacement can be achieved in any suitable manner, such as through sliding of securement devices 236 along slots 234 of the side panels, for example.

In an extended or otherwise fully deployed condition, crash attenuation assembly 100 is ready for use associated with the impact of an errant vehicle VHC, such as is shown in FIG. 5, for example. To dissipate kinetic energy associated with and decelerate the errant vehicle, crash attenuation assembly 100 also includes a plurality of compressible energy absorbers that are operatively disposed between adjacent ones of the frame assemblies and/or between one of the frame assemblies and the stationary frame assembly. It will be appreciated that the plurality of compressible energy absorbers can be of any suitable size, shape, configuration and/or construction, and can be manufactured from any suitable combination of one or more materials. As non-limiting examples, the compressible energy absorbers could be at least partially formed from any one or more of metal, polymeric materials and/or polymeric foam materials. In some cases, the compressible energy absorbers can, optionally, include an energy absorption body that is at least partially encased within an energy absorption shell. In such constructions, the energy absorption bodies can be formed from a compressible metal structure, polymeric foam and/or other suitable materials. Additionally, in such constructions, the energy absorption shells can include one or more walls and/or wall portions formed from metal, polymeric material (e.g., thermoplastic), and/or other suitable materials. One non-limiting example of suitable construction for compressible energy absorbers is shown and described herein in the form of energy absorption cartridges CT1-CT7, which are described in detail hereinafter. It is to be recognized and understood, however, that other configurations and/or constructions of compressible energy absorbers could alternately be used and that the subject matter of the present disclosure is not intended to be limited to use in connection with compressible energy absorbers in the form of energy absorption cartridges CT1-CT7, which are merely exemplary.

Again, as a non-limiting example, energy absorption cartridges CT1-CT7 are shown as being disposed within bays BY1-BY7, respectively, and are compressed between adjacent ones of frame assemblies FA1-FA7 (and/or between frame assembly FA7 and stationary frame assembly 112) upon impact of assembly 100 by errant vehicle VHC. In some cases, bays BY1-BY7 and the corresponding energy absorption cartridges can collapse or otherwise dimensionally change (in at least the longitudinal direction) at two or more different rates during an impact event, such as is shown in FIG. 5, for example. That is, the bays and corresponding energy absorption cartridges can collapse in series (i.e., one after another). In other cases, the frame assemblies, bays and corresponding energy absorption cartridges can be displaced longitudinally along guide rails at an approximately common rate. That is, the bays and corresponding energy absorption cartridges can collapse contemporaneously with one another and at a dimensional rate of change that is approximately equal to one another. In still other cases, the frame assemblies, bays and corresponding energy absorption cartridges can be configured or otherwise arranged to collapse in a combination rates, such as with two or more energy absorption cartridges collapsing at a common rate and two or more energy absorption cartridges collapsing in series relative to one another.

Energy absorption cartridges CT1-CT7 can be constructed in any manner suitable for the cartridges to collapse under the compressive forces experienced during an impact event and thereby absorb or otherwise dissipate kinetic energy of an errant vehicle. As one non-limiting example, energy absorption cartridges CT1-CT7 can include a cartridge shell or housing 238 and an energy absorption body 240 that is disposed within the cartridge shell. In some cases, cartridge shell 238 can include shell sections 242 and 244 that are assembled together, such as by way of a flowed-material joint, for example, to at least partially define a cartridge chamber 246 within which energy absorption body 240 is encased. In a preferred arrangement, energy absorption body 240 can be permanently encased within cartridge shell 238, such as by permanently joining (i.e., inseparable without damage, destruction or material alteration of at least one of the component parts) shell sections 242 and 244 by way of an adhesive or other flowed-material joint, for example. In an assembled condition of shell sections 242 and 244, cartridge shell 238 includes at least one cartridge shell wall 248 that at least partially defines cartridge chamber 246. Cartridge shell wall 248 can include a wall portion 250 and a wall portion 252 that is offset from wall portion 250. In some cases, wall portions 250 and 252 can be disposed in a generally horizontal orientation such that wall portions 250 and 252, respectively, at least partially define a bottom and a top of cartridges CT1-CT7. Cartridge shell wall 248 can also include wall portions 254 and 256 that, in an assembled condition of shell sections 242 and 244, extend between and operatively connect wall portions 250 and 252. Cartridge shell wall 248 can further include wall portions 258 and 260 that are oriented transverse to wall portions 254 and 256. Wall portions 258 and 260 also extend between and operatively connect wall portions 250 and 252, in an assembled condition of shell sections 242 and 244. With wall portions 250 and 252 disposed in a generally horizontal orientation, wall portions 254 and 256 can, respectively, at least partially define front and rear ends of cartridges CT1-CT7 with wall portions 258 and 260 forming opposing sides of the cartridges.

Energy absorption cartridges CT1-CT7 can be supported within bays BY1-BY7 of the crash attenuation assembly in any suitable manner. As a non-limiting example, wall portion 250 of cartridge shell 238 can be disposed on or along surface portions 180 of cartridge support brackets 178 on adjacent ones of frame assemblies FA1-FA7. In a preferred arrangement, cartridge shell wall 248 is formed from a polymeric material. In some cases, a plurality of corrugations or pleats 262 can be included on or along any one or more of wall portions 250-260. Pleats 262 can be arranged in parallel with one another to promote or otherwise aid in the controlled compression and collapse (in the longitudinal direction) of cartridges CT1-CT7 during an impact event. As energy absorption cartridges CT1-CT7 are compressed during an impact event, wall portions 254 and 256 are displaced toward one another through at least the collapse of pleats 262 and energy absorption body 240 is crushed or otherwise compressed in at least a longitudinal direction between at least wall portions 254 and 256.

It will be appreciated that energy absorption body 240 can be of any suitable size, shape, configuration and/or construction. As non-limiting examples, the energy absorption body can have a circular, square, rectangular or other polygonal cross-sectional shape that extends uniformly (e.g., cylindrical, prism) or with variable size and/or shape in the direction perpendicular to the cross-sectional shape (e.g., polyhedron). For discussion purposes, regardless of the shape and/or configuration thereof, energy absorption body 240 is illustrated as extending in longitudinal or lengthwise direction LNG, lateral or widthwise direction LAT, and vertical or heightwise direction VRT with lateral direction LAT oriented substantially perpendicular to longitudinal direction LNG and vertical direction VRT oriented substantially perpendicular to longitudinal and lateral directions LNG and LAT.

In the arrangement shown and described herein, energy absorption body 240 is in the shape of a cuboid (e.g., a square prism or cube, a rectangular prism or cube). As such, energy absorption body 240 includes surface portions 264 and 266 that face opposite one another and are spaced apart in vertical direction VRT. The energy absorption body also includes surface portions 268 and 270 that face away from one another and are spaced apart from one another in longitudinal direction LNG. Energy absorption body 240 further includes surface portions 272 and 274 that face opposite one another and are spaced apart from one another in lateral direction LAT.

In an assembled condition in which energy absorption body 240 is disposed within cartridge chamber 246, surface portions 264 and 266 are respectively oriented in facing relation to wall portions 250 and 252, surface portions 268 and 270 are respectively oriented in facing relation to wall portions 254 and 256, and surface portions 272 and 274 are respectively oriented in facing relation to wall portions 258 and 260. For discussion purposes, in such an arrangement, surface portions 264 and 266 may be respectively referred to as a bottom (or bottom surface portion) and a top (or top surface portion) of the energy absorption body with surface portions 268 and 270 being respectively referred to as vertical ends (or vertical end surface portions) and surface portions 272 and 274 respectively referred to as vertical sides (or vertical side surface portions) of the energy absorption body.

It will be appreciated that energy absorption body 240 can be formed from any suitable material or combination of materials. For example, energy absorption body 240 can be at least partially formed of polymeric foam material. In a preferred arrangement, energy absorption body 240 can be substantially-entirely formed from a rigid or structural polymeric foam material. In a more preferred arrangement, the structural polymeric foam material is an anisotropic polymeric foam material that has a compressive strength in one direction (e.g., longitudinal direction LNG) that is greater than the compressive strength of the foam material in at least one other direction (e.g., lateral direction LAT and/or vertical direction VRT). That is, the anisotropic polymeric foam can have a so-called "grain" such that the material exhibits a first compressive strength in a first direction (e.g., longitudinal direction LNG) and a second compressive strength that is different (e.g., less than) from the first compressive strength in a second direction (e.g., lateral direction LAT) that is transverse to the first direction. In a third direction (e.g., vertical direction VRT) that is transverse to the first and second directions, the material has approximately the second compressive strength or a third compressive strength that is different (e.g., less than) from the first and second compressive strengths.

Using such an anisotropic polymeric foam material, energy absorption bodies of substantially similar sizes, shapes and/or configurations can be manufactured that have different compressive strengths in a common direction of compression or use (e.g., longitudinal direction LNG). This is achieved by manufacturing the energy absorption bodies with the grain of the anisotropic polymeric foam material oriented in alternating or otherwise differing combinations of directions. That is, the compressive strength of different ones of energy absorption bodies 240 can be varied simply by manufacturing the energy absorption bodies from a common anisotropic polymeric foam material with the grain oriented in alternating or otherwise differing directions. The term compressive strength generally refers to specific energy absorption associated with compression of material a certain distance in a specific direction, such as a direction of impact. In some cases, specific energy absorption can be characterized as the area under a stress vs strain curve, such as may correspond to a given direction of compression of the anisotropic polymeric foam material relative to the grain thereof.

It will be appreciated that cartridge shells 238 of energy absorption cartridges CT1-CT7 can have an approximately uniform overall construction that contributes a consistent (and often minimal) compressive strength in the longitudinal direction with respect to the overall compressive strength of energy absorption cartridges CT1-CT7. As such, the overall compressive strength of energy absorption cartridges CT1-CT7 will substantially correspond to the compressive strength of the energy absorption body respectively contained therein, which energy absorption body can have one of two or more different constructions with one of two or more compressive strengths respectively corresponding thereto.

Figure 12:
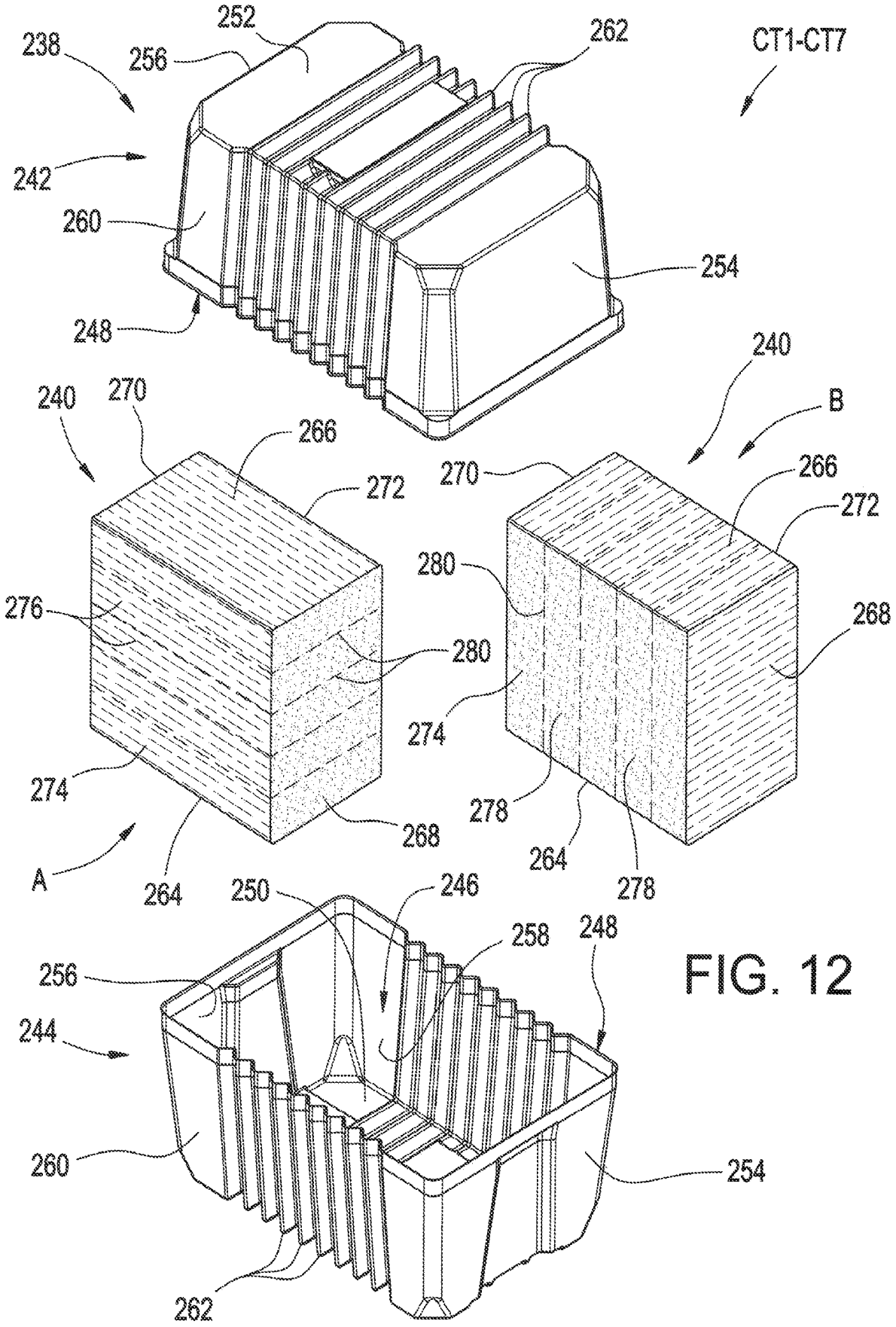
FIG. 12 is an exploded view of an exemplary energy absorption cartridge illustrating examples of alternate energy absorption bodies.
Figure 13:
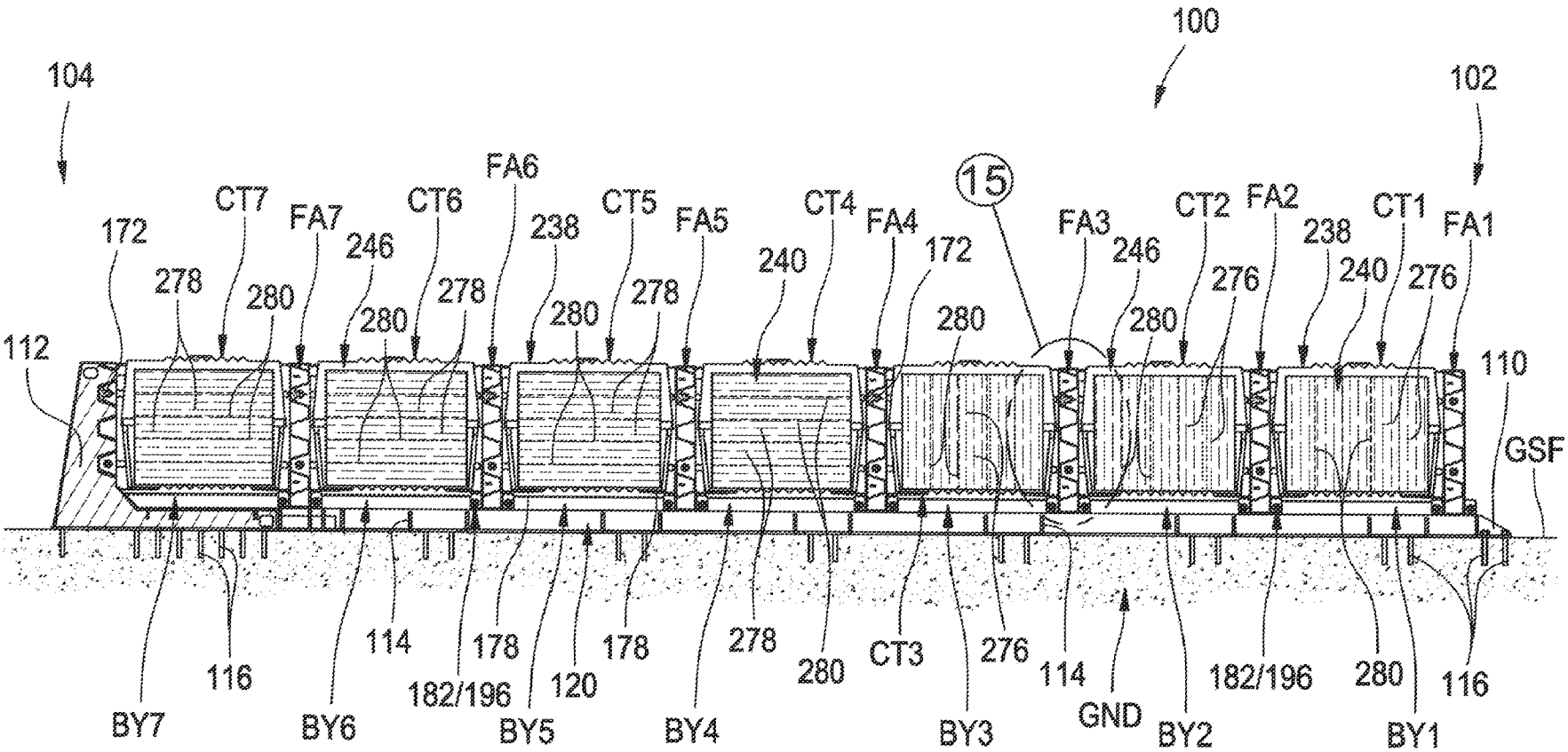
FIG. 13 is a cross-sectional view of the exemplary crash attenuation assembly in FIGS. 1-12 taken from along line 13-13 in FIG. 2 and illustrating an exemplary arrangement of energy absorption cartridges.
Figure 14:
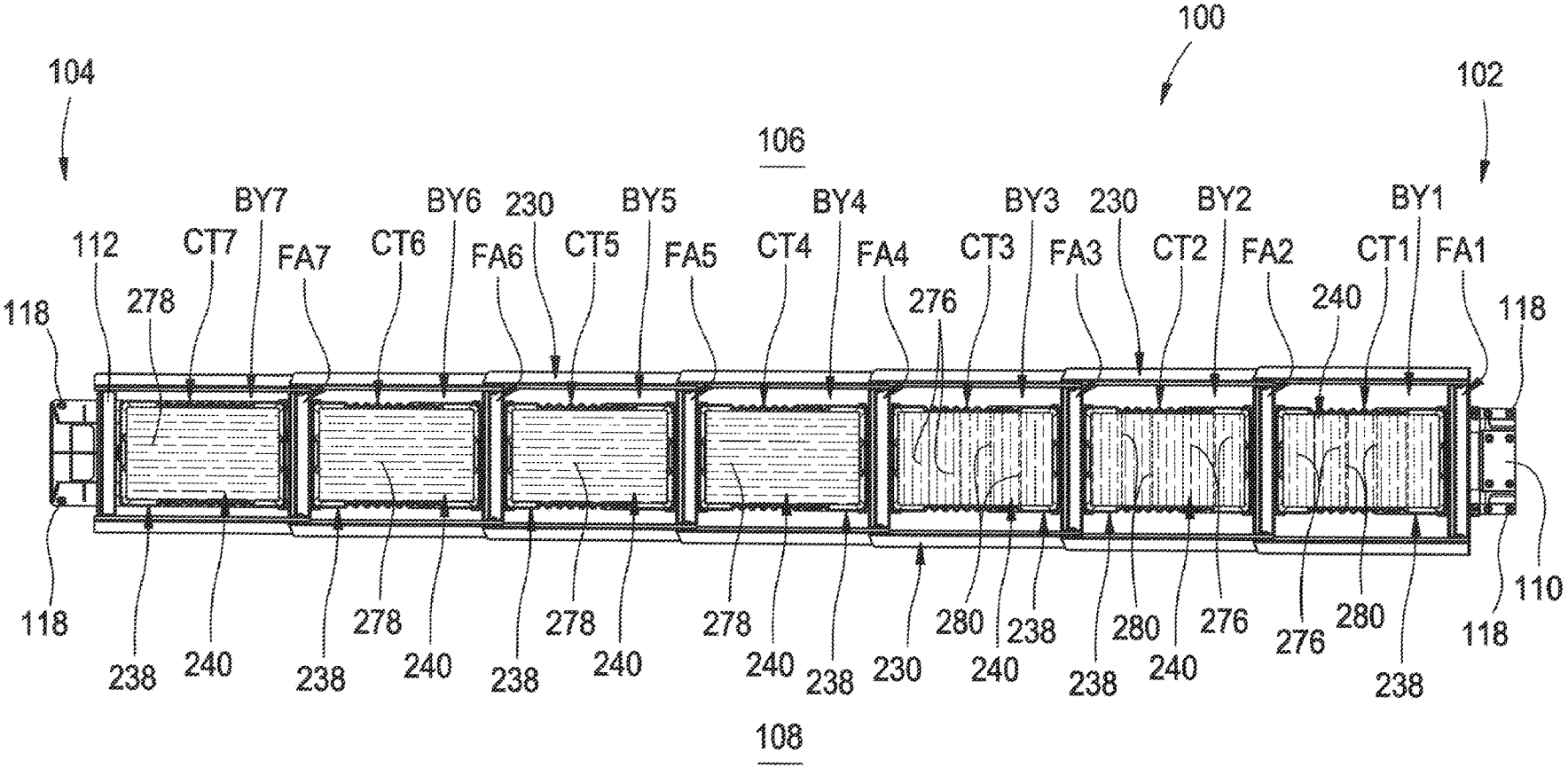
FIG. 14 is a cross-sectional view of the exemplary crash attenuation assembly in FIGS. 1-13 taken from along line 14-14 in FIG. 4.

In some cases, the energy absorption bodies of energy absorption cartridges CT1-CT7 can be formed as commonly-shaped, monolithic masses of anisotropic foam material. In other cases, energy absorption bodies 240 within each of energy absorption cartridges CT1-CT7 can be laminated or otherwise assembled into commonly-shaped masses from a plurality of blocks and/or slabs 276 and/or 278 of a common anisotropic polymeric foam material that are attached to one another in a suitable manner, such as by way of adhesive or flowed-material joints 280, for example. As one non-limiting example, one or more of energy absorption bodies 240 could include blocks 276 oriented and assembled such that the first (or primary) compression strength of the anisotropic polymeric foam material is at least approximately aligned in longitudinal direction LNG, such as is identified by reference character "A" in FIG. 12, for example. Energy absorption bodies having such an arrangement exhibit a first compressive strength in the longitudinal direction of compression. As another non-limiting example, one or more of energy absorption bodies 240 could include blocks 278 oriented and assembled together such that the first (or primary) compression strength of the anisotropic polymeric foam material is at least approximately aligned in lateral direction LAT (or vertical direction VRT) with the secondary compression strength at least approximately aligned in longitudinal direction LNG, such as is identified by reference character "B" in FIG. 12, for example. Energy absorption bodies having such an arrangement exhibit a second compressive strength in the longitudinal direction of compression.

Regardless of the manner of construction (i.e., monolithic or laminated blocks), energy absorption bodies 240 are constructed to have a predetermined compressive strength in at least the primary direction of compression (i.e., longitudinal direction LNG) that can vary from energy absorption body-to-energy absorption body depending on the orientation and/or arrangement of anisotropic polymeric foam material thereof. As such, different ones of energy absorption cartridges CT1-CT7 can have different overall compressive strengths in the direction of compression (i.e., longitudinal direction LNG) based on the configuration of the energy absorption body encased therein. Through the use of one or more energy absorption cartridges having a first overall compressive strength in the longitudinal direction and one or more energy absorption cartridges having a second overall compressive strength in the longitudinal direction (that differs from the first overall compressive strength), crash attenuation assembly 100 can be configured to achieve certain desired or otherwise predetermined performance characteristics, such as total energy absorption and/or overall longitudinal deflection, for example.

It will be appreciated that crash attenuation assembly 100 will experience impact events having a wide range of different kinetic energies, such as may be associated with errant vehicles of different sizes (i.e., masses) impacting the crash attenuation assembly at different speeds and/or different angles of impact. As such, the crash attenuation assembly will undergo full longitudinal displacement during high energy impact event. In such cases, the compressible energy absorbers operatively associated therewith (e.g., energy absorption cartridges CT1-CT7) are typically permanently compressed to the extent that the compressible energy absorbers are incapable of reuse and are to be replaced prior to crash attenuation assembly 100 being deemed ready-for-use and returned to service. Under such circumstances, at least some of the compressible energy absorbers will be damaged or permanently deformed to the extent that it will be obvious to a maintenance worker that the compressible energy absorbers are incapable of further use (i.e., reuse).

In other cases, however, one or more of the compressible energy absorbers (e.g., energy absorption cartridges CT1-CT7) may be partially or even minimally compressed, such as during a lower-energy impact event, for example. Under such circumstances, a maintenance worker may be unable to determine from a visual inspection of the exterior of the compressible energy absorbers, whether a given compressible energy absorber has exceeded a predetermined compression threshold beyond which the compressible energy absorber is rendered unfit for use. As a non-limiting example, cartridge shell 238 can be manufactured from a durable polymeric material that may return to its original size and shape after a low-energy impact event. Whereas energy absorption body 240 is constructed to crush or otherwise at least semi-permanently compress during even low-energy impact events. As such, a maintenance worker may be unable to determine from an external, visual inspection whether or not the energy absorption cartridges and/or energy absorption bodies therein that have experienced a lower-energy impact event are in condition for reuse.

As such, in accordance with the subject matter of the present disclosure, one or more of frame assemblies FA1-FA7 and/or stationary frame assembly 112 can include one or more of piercing devices 172 attached thereto. Under conditions in which a given compressible energy absorber (e.g., one of energy absorption cartridges CT1-CT7) undergoes an amount of compression that exceeds a predetermined threshold, piercing devices 172 will penetrate into the compressible energy absorber thereby creating an aperture or other indicator that is visually observable by a maintenance worker and operates as an indication that the compressible energy absorber is unsuitable for reuse.

Figure 15:
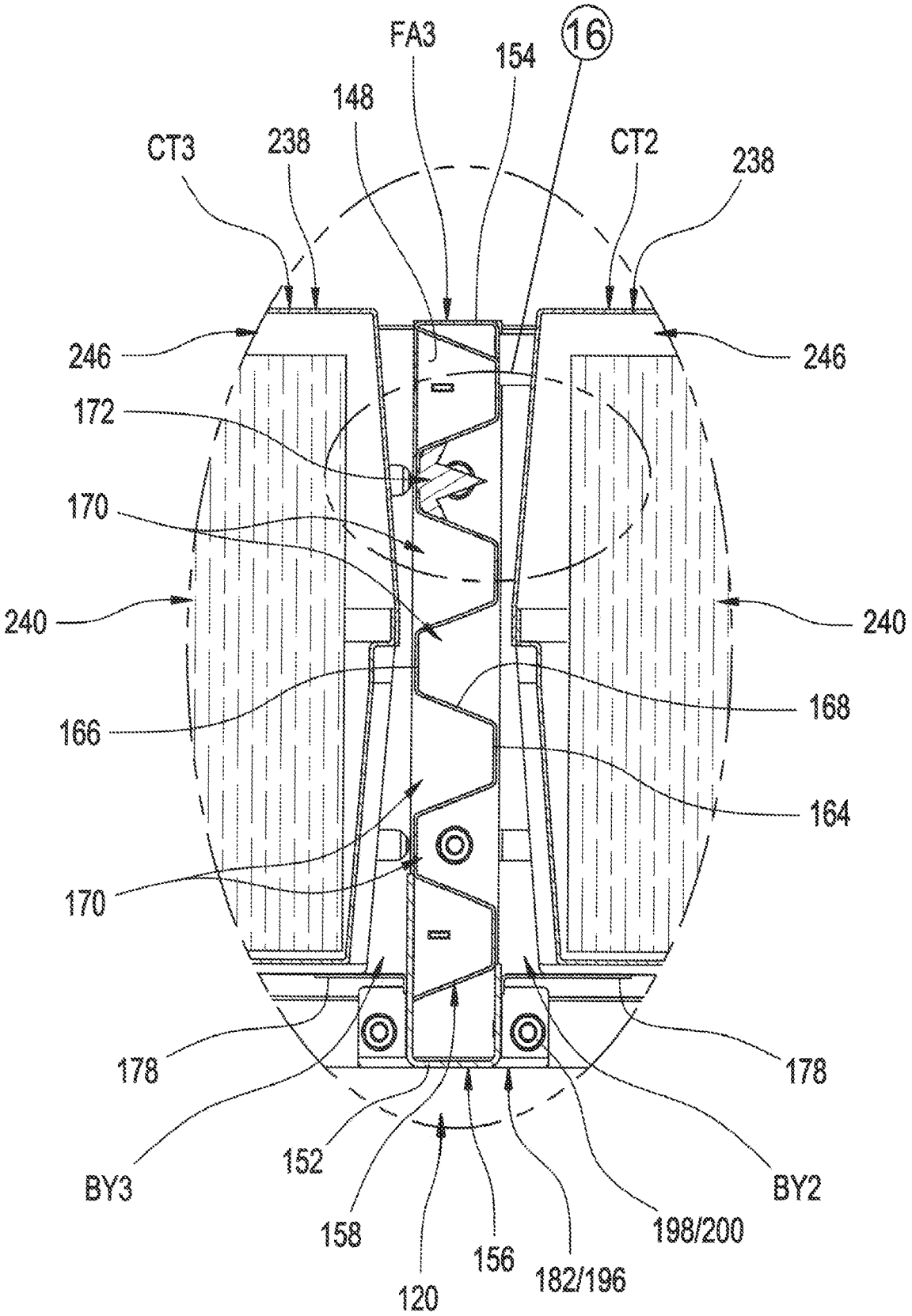
FIG. 15 is an enlarged view of the portion of the exemplary crash attenuation assembly in FIGS. 1-14 identified as Detail 15 in FIG. 13.
Figure 16:
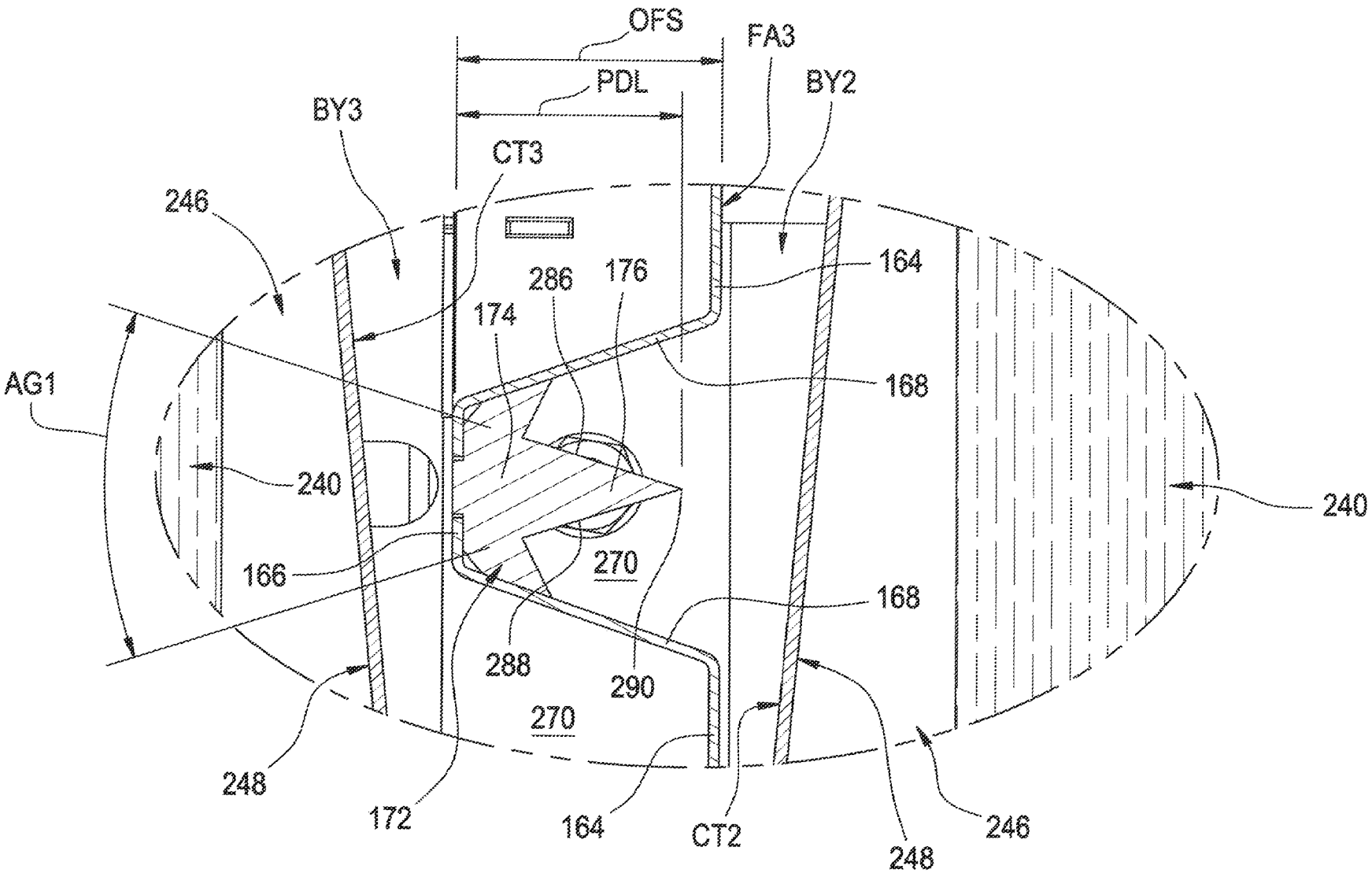
FIG. 16 is an enlarged view of the portion of the exemplary crash attenuation assembly in FIGS. 1-15 identified as Detail 16 in FIG. 15.
Figure 17:
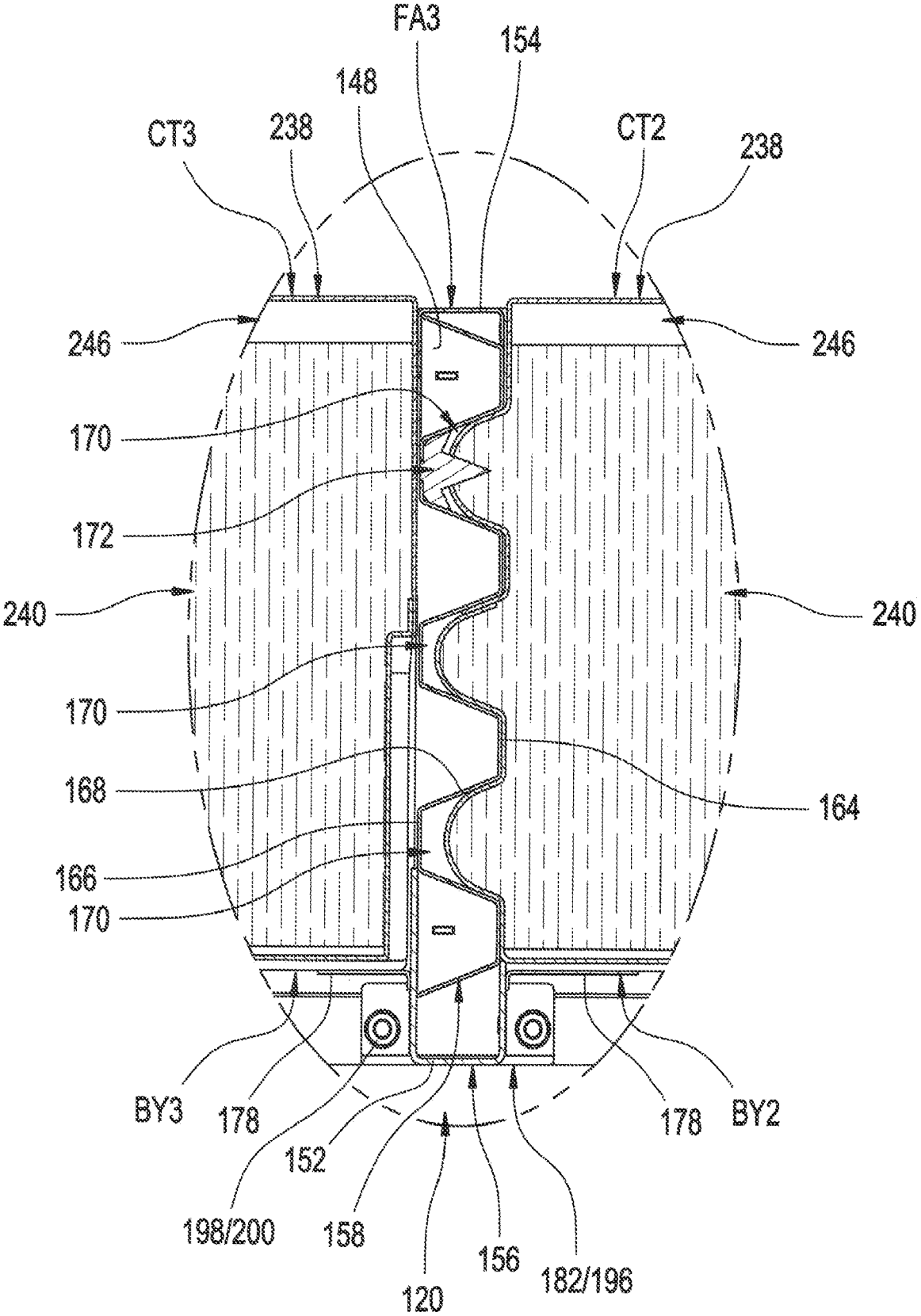
FIG. 17 is the enlarged view of the portion of the exemplary crash attenuation assembly in FIG. 15 shown in a compressed condition, such as from the impact event in FIG. 5.
Figure 18:
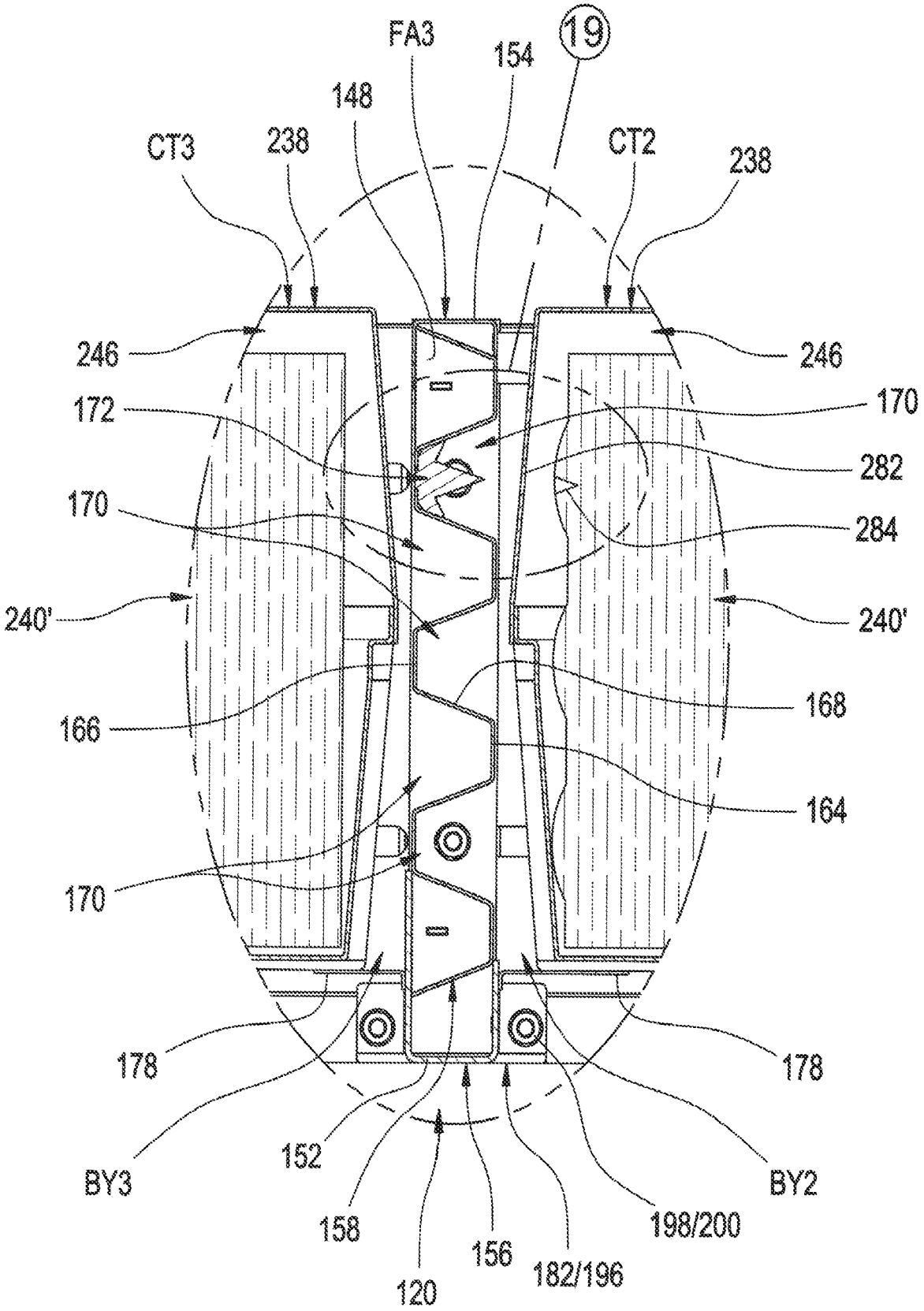
FIG. 18 is the enlarged view of the portion of the exemplary crash attenuation assembly in FIGS. 15-17 shown with a visually-observable integrity indicator formed along the exemplary energy absorption cartridge, such as from the impact event in FIG. 5.
Figure 19:
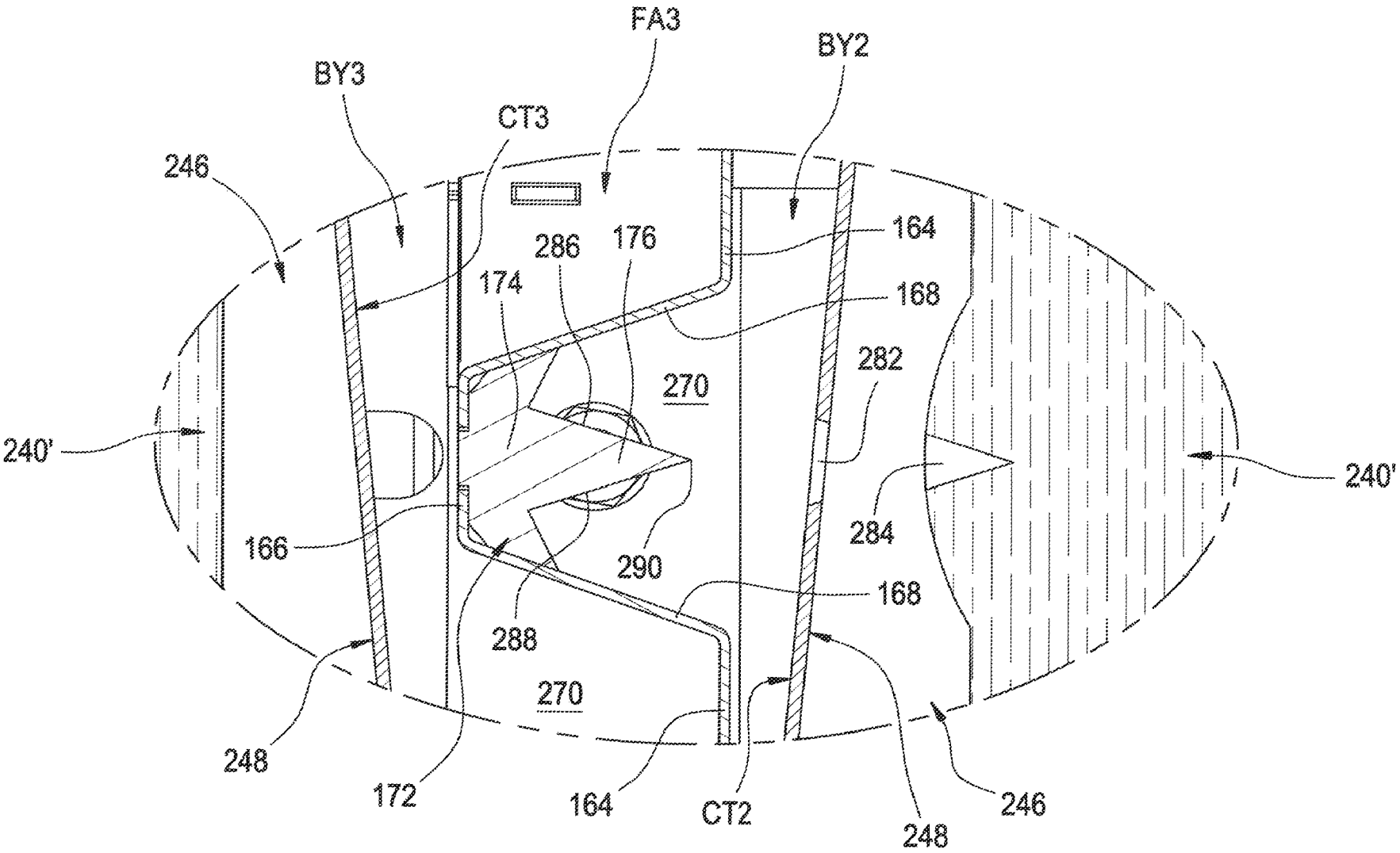
FIG. 19 is an enlarged view of the portion of the exemplary crash attenuation assembly in FIGS. 1-18 identified as Detail 19 in FIG. 18.

As one non-limiting example of such operation in connection with energy absorption cartridges CT1-CT7, one of piercing devices 172 can penetrate through shell wall 248 and into cartridge chamber 246 thereby creating an aperture 282 within the shell wall and/or an aperture 284 in energy absorption body 240 that is visually observable by a maintenance worker and operates as an indication that the compressible energy absorber is unsuitable for reuse. For example, FIGS. 15 and 16 illustrate crash attenuation assembly 100 in a ready-for-use condition. During a lower-energy impact, one or more of the compressible energy absorbers (e.g., energy absorption cartridges CT1-CT7) are compressed such that a portion of the compressible energy absorbers (e.g., shell wall 248 and energy absorption body 240) are forced into engagement with corresponding ones of frame assemblies FA1-FA7, such as is shown in FIG. 17, for example. In such a compressed condition, piercing device 172 penetrates into the compressible energy absorber (e.g., penetrates through shell wall 248 and into cartridge chamber 246) thereby creating apertures 282 and/or 284. Once the kinetic energy associated with the lower-energy impact event has been absorbed by the crash attenuation assembly, cartridge shell 238 may return to its original size and/or shape, such as is shown in FIGS. 18 and 19, for example. In such cases, however, energy absorption body 240' remains in a compressed or otherwise deformed condition that it is unsuitable for further use, as indicated by apertures 282 and/or 284.

It will be appreciated that piercing device 172 can be of any suitable size, shape and/or configuration. As one non-limiting example, piercing device 172 can be formed as a thin-walled metal plate that extends from base portion 174 toward tip wall portion 176. In some cases, tip wall portion 176 can include a tip edge 286 and a tip edge 288 that extend at an acute angle AG1 relative to one another to at least partially define a distal tip 290 that is sufficiently pointed to penetrate into compressible energy absorber (e.g., penetrate through shell wall 248 and/or into energy absorption body 240), as discussed above. First wall portions 164 and second wall portions 166 are offset from one another as described above, such as is represented in FIG. 16 by reference dimension OFS. In a preferred arrangement, piercing device 172 can have an overall length (or dimension in the lengthwise direction) from base portion 174 to distal tip 290, such as is represented by reference dimension PDL in FIG. 16, for example. In a preferred arrangement, piercing device length PDL is less than or equal to offset dimension OFS. In this manner, with base portion 174 of the piercing device attached to one of wall portions 164 and 166, distal tip 290 will remain even with the other of wall portions 164 and 166 or otherwise positioned within corrugation groove 170.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language. Additionally, the term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of components, devices, systems, functions, steps and/or acts are inherently mutually exclusive. Furthermore, the terms "transverse," and the like, are to be broadly interpreted. As such, the terms "transverse," and the like, can include a wide range of relative angular orientations that include, but are not limited to, an approximately perpendicular angular orientation. Also, the terms "circumferential," "circumferentially," and the like, are to be broadly interpreted and can include, but are not limited to circular shapes and/or configurations. In this regard, the terms "circumferential," "circumferentially," and the like, can be synonymous with terms such as "peripheral," "peripherally," and the like.

It will be recognized that numerous different features and/or components are presented in the embodiments shown and described herein, and that no one embodiment may be specifically shown and described as including all such features and components. As such, it is to be understood that the subject matter of the present disclosure is intended to encompass any and all combinations of the different features and components that are shown and described herein, and, without limitation, that any suitable arrangement of features and components, in any combination, can be used. Thus, it is to be distinctly understood claims directed to any such combination of features and/or components, whether or not specifically embodied herein, are intended to find support in the present disclosure. To aid the Patent Office and any readers of this application and any resulting patent in interpreting the claims appended hereto, Applicant does not intend any of the appended claims or any claim elements to invoke 35 U.S.C. 112(f) unless the words "means for" or "step for" are explicitly used in the particular claim.

While the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations.

The inventin claimed is:

1. A crash attenuator assembly operable to decelerate an associated errant vehicle during an associated impact event, said crash attenuator assembly comprising:

a guide rail anchorable to an associated ground surface adjacent an associated roadway, said guide rail extending in a longitudinal direction from a first rail end to a second rail end opposite said first rail end;

a plurality of frame assemblies supported on said guide rail for longitudinal displacement therealong due to impact of the associated errant vehicle, said plurality of frame assemblies oriented transverse to said guide rail and extending therefrom in a vertical direction away from the associated ground surface, said plurality of frame assemblies disposed in longitudinally-spaced relation to one another along said guide rail such that a plurality of bays are defined longitudinally along said guide rail with each of said plurality of bays disposed between adjacent ones of said plurality of frame assemblies, one of said plurality of frame assemblies including a piercing device disposed in facing relation to a corresponding one of said plurality of bays; and, a compressible energy absorber disposed within said one of said plurality of bays, said compressible energy absorber having a pre-impact shape;

said piercing device operative to penetrate into said compressible energy absorber thereby creating an aperture operable as a visually observable identifier of compression of said compressible energy absorber during the associated impact event to an amount exceeding a predetermined compression threshold upon post-impact return of said compressible energy absorber to at least approximately said pre-impact shape.

2. A crash attenuator assembly according to claim 1, wherein said one of said plurality of frame assemblies includes a frame structure supported on said guide rail and a frame panel attached to said frame structure with said piercing device attached to said frame panel.

3. A crash attenuator assembly according to claim 2, wherein said frame panel includes a panel wall with a plurality of first wall portions, a plurality of second wall portions that are offset from said plurality of first wall portions in said longitudinal direction by an offset dimension, and a plurality of third wall portions that extend between and operatively connect adjacent ones of said plurality of first wall portions with said plurality of second wall portions such that a plurality of first corrugation grooves face toward said first rail end of said guide rail and a plurality of second corrugation grooves face toward said second rail end of said guide rail.

4. A crash attenuator assembly according to claim 3, wherein said piercing device is disposed within one of said plurality of first corrugation grooves or within one of said plurality of second corrugation grooves.

5. A crash attenuator assembly according to claim 4, wherein said piercing device includes a base wall portion and a tip wall portion extending from said base wall portion toward a distal piercing tip with said base wall portion attached to either one of said plurality of first wall portions or one of said plurality of second wall portions.

6. A crash attenuator assembly according to claim 5, wherein said tip wall portion includes a first tip edge and a second tip edge disposed at an acute angle relative to one another and at least partially defining said distal piercing tip.

7. A crash attenuator assembly according to claim 6, wherein said piercing device includes a piercing device length from said base wall portion to said distal piercing tip that is less than or equal to said offset dimension between said plurality of first wall portions and said plurality of second wall portions of said panel wall such that said piercing device is substantially entirely contained within said one of said plurality of first corrugation grooves or within said one of said plurality of second corrugation grooves.

8. A crash attenuator assembly operable to decelerate an associated errant vehicle during an associated impact event, said crash attenuator assembly comprising:

a guide rail anchorable to an associated ground surface adjacent an associated roadway, said guide rail extending in a longitudinal direction from a first rail end to a second rail end opposite said first rail end;

a plurality of frame assemblies supported on said guide rail for longitudinal displacement therealong due to impact of the associated errant vehicle, said plurality of frame assemblies oriented transverse to said guide rail and extending therefrom in a vertical direction away from the associated ground surface, said plurality of frame assemblies disposed in longitudinally-spaced relation to one another along said guide rail such that a plurality of bays are defined longitudinally along said guide rail with each of said plurality of bays disposed between adjacent ones of said plurality of frame assemblies, one of said plurality of frame assemblies including a piercing device disposed in facing relation to a corresponding one of said plurality of bays; and, a compressible energy absorber disposed within said one of said plurality of bays, said compressible energy absorber including an energy absorption body at least partially formed from a polymeric foam material;

said piercing device operative to penetrate into said compressible energy absorber thereby creating an aperture in said compressible energy absorber and said energy absorption body thereof that is operable as a visually observable identifier of compression of said compressible energy absorber during the associated impact event to an amount exceeding a predetermined compression threshold.

9. A crash attenuator assembly according to claim 8, wherein said polymeric foam material is an anisotropic polymeric foam material that exhibits a first energy absorption value when compressed in a first body direction and a second energy absorption value when compressed in a second body direction that is transverse to said first body direction.

10. A crash attenuator assembly operable to decelerate an associated errant vehicle during an associated impact event, said crash attenuator assembly comprising:

a guide rail anchorable to an associated ground surface adjacent an associated roadway, said guide rail extending in a longitudinal direction from a first rail end to a second rail end opposite said first rail end;

a first frame assembly disposed along said first end of said guide rail and supported for sliding displacement longitudinally therealong;

a second frame assembly disposed along said second end of said guide rail and anchorable in stationary relation thereto;

a plurality of intermediate frame assemblies supported on said guide rail for sliding displacement longitudinally therealong, said plurality of intermediate frame assemblies disposed in spaced relation to one another between said first and second frame assemblies such that a plurality of bays are defined longitudinally along said crash attenuator assembly with one of said plurality of bays between adjacent ones of said first frame assembly, said second frame assembly and said plurality of intermediate frame assemblies;

a piercing device supported on said first frame assembly, said second frame assembly or one of said plurality of intermediate frame assemblies, said piercing device oriented in facing relation to an adjacent one of said plurality of bays; and, a plurality of compressible energy absorbers with each of said plurality of compressible energy absorbers disposed within a different one of said plurality of bays, and each of said plurality of compressible energy absorbers having a pre-impact shape;

said piercing device operative to penetrate into one of said plurality of compressible energy absorbers upon compression of said one of said plurality of compressible energy absorbers in an amount exceeding a predetermined compression threshold thereby creating an aperture operable as a visually observable identifier of compression of said one of said plurality of compressible energy absorbers to an amount exceeding said predetermined compression threshold upon post-impact return of said one of said plurality of compressible energy absorbers to at least approximately said pre-impact shape thereof.

11. A crash attenuator assembly according to claim 10, wherein said piercing device is one of a plurality of piercing devices with at least one of said plurality of piercing devices supported on at least said second frame assembly and each of said plurality of intermediate frame assemblies.

12. A crash attenuator assembly according to claim 10, wherein said first frame assembly, said second frame assembly or at least one of said plurality of intermediate frame assemblies includes a frame structure supported on said guide rail and a frame panel attached to said frame structure with said piercing device attached to said frame panel.

13. A crash attenuator assembly according to claim 12, wherein said frame panel includes a panel wall with a plurality of corrugations extending across said frame structure in a direction transverse to said longitudinal direction.

14. A crash attenuator assembly according to claim 13, wherein said panel wall includes a plurality of first wall portions, a plurality of second wall portions that are offset from said plurality of first wall portions in said longitudinal direction by an offset dimension, and a plurality of third wall portions that extend between and operatively connect adjacent ones of said plurality of first wall portions with said plurality of second wall portions such that a plurality of first corrugation grooves face toward said first rail end of said guide rail and a plurality of second corrugation grooves face toward said second rail end of said guide rail.

15. A crash attenuator assembly according to claim 14, wherein said piercing device is disposed within one of said plurality of first corrugation grooves or within one of said plurality of second corrugation grooves.

16. A crash attenuator assembly according to claim 14, wherein said piercing device includes a base wall portion and a tip wall portion extending from said base wall portion toward a distal piercing tip with said base wall portion attached to either one of said plurality of first wall portions or one of said plurality of second wall portions.

17. A crash attenuator assembly according to claim 16, wherein said tip wall portion includes a first tip edge and a second tip edge disposed at an acute angle relative to one another and at least partially defining said distal piercing tip.

18. A crash attenuator assembly according to claim 16, wherein said piercing device includes a piercing device length from said base wall portion to said distal piercing tip that is less than or equal to said offset dimension between said plurality of first wall portions and said plurality of second wall portions of said panel wall such that said piercing device is substantially entirely contained within said one of said plurality of first corrugation grooves or within said one of said plurality of second corrugation grooves.

19. A crash attenuator assembly according to claim 10, wherein one or more of said plurality of compressible energy absorbers includes an energy absorption body at least partially formed from a polymeric foam material with said piercing device creating said aperture in said energy absorption body.

20. A crash attenuator assembly according to claim 19, wherein said polymeric foam material is an anisotropic polymeric foam material that exhibits a first energy absorption value when compressed in a first body direction and a second energy absorption value when compressed in a second body direction that is transverse to said first body direction.

* * * * *